US012188138B1

(12) United States Patent
Schreiber et al.

(10) Patent No.: US 12,188,138 B1
(45) Date of Patent: Jan. 7, 2025

(54) ELECTROCHEMICAL CARBON OXIDES REDUCTION TO ETHYLENE

(71) Applicants: TOTALENERGIES ONETECH, Courbevoie (FR); COLLÈGE DE FRANCE, Paris (FR)

(72) Inventors: Moritz Wilhelm Schreiber, Seneffe (BE); Hong-Phong Duong, Paris (FR); Ngoc Huan Tran, Paris (FR); Marc Fontecave, Paris (FR)

(73) Assignees: TOTALENERGIES ONETECH, Courbevoie (FR); COLLÈGE DE FRANCE, Paris (FR)

( * ) Notice: Subject to any disclaimer, the term of this patent is extended or adjusted under 35 U.S.C. 154(b) by 0 days.

(21) Appl. No.: 18/723,935

(22) PCT Filed: Jan. 3, 2023

(86) PCT No.: PCT/EP2023/050055

§ 371 (c)(1),
(2) Date: Jun. 25, 2024

(87) PCT Pub. No.: WO2023/131604

PCT Pub. Date: Jul. 13, 2023

(30) Foreign Application Priority Data

Jan. 10, 2022 (EP) ..... 22315009
Jul. 1, 2022 (EP) ..... 22182561

(51) Int. Cl.
*C25B 3/03* (2021.01)
*C23C 8/10* (2006.01)
(Continued)

(52) U.S. Cl.
CPC ..... *C25B 3/03* (2021.01); *C23C 8/10* (2013.01); *C23C 28/32* (2013.01); *C23C 28/345* (2013.01); *C25B 1/23* (2021.01); *C25B 3/25* (2021.01); *C25B 3/26* (2021.01); *C25B 9/19* (2021.01); *C25B 9/23* (2021.01); *C25B 11/032* (2021.01); *C25B 11/052* (2021.01);
(Continued)

(58) Field of Classification Search
None
See application file for complete search history.

(56) References Cited

U.S. PATENT DOCUMENTS

2018/0195184 A1* 7/2018 Fleischer ..... C25B 15/083
2021/0140056 A1 5/2021 Jiao et al.

FOREIGN PATENT DOCUMENTS

EP 3656892 A1 * 5/2020 ..... C25B 1/04
WO 2012125053 A2 9/2012
(Continued)

OTHER PUBLICATIONS

International Search Report and Written Opinion issued in Application No. PCT/EP2023/050055, dated Mar. 30, 2023, 12 pages.
(Continued)

*Primary Examiner* — Wojciech Haske
(74) *Attorney, Agent, or Firm* — Ewing & Jones, PLLC

(57) ABSTRACT

The invention relates to a process for electrolysing carbon oxides selected from carbon monoxide and/or carbon dioxide into ethylene by means of an electrolyser comprising a cathode catalyst being a dendritic copper oxide catalyst or a dendritic copper catalyst.

20 Claims, 14 Drawing Sheets

(51) Int. Cl.

| | |
|---|---|
| ***C23C 28/00*** | (2006.01) |
| ***C25B 1/23*** | (2021.01) |
| ***C25B 3/25*** | (2021.01) |
| ***C25B 3/26*** | (2021.01) |
| ***C25B 9/19*** | (2021.01) |
| ***C25B 9/23*** | (2021.01) |
| ***C25B 11/032*** | (2021.01) |
| ***C25B 11/052*** | (2021.01) |
| ***C25B 11/061*** | (2021.01) |
| ***C25B 11/075*** | (2021.01) |
| ***C25D 3/38*** | (2006.01) |
| ***C25D 5/50*** | (2006.01) |

(52) U.S. Cl.
CPC ..... *C25B 11/061* (2021.01); *C25B 11/075* (2021.01); *C25D 3/38* (2013.01); *C25D 5/50* (2013.01)

(56) References Cited

FOREIGN PATENT DOCUMENTS

| | | | | |
|---|---|---|---|---|
| WO | WO-2020157151 A1 * | 8/2020 | ..... | C25B 1/00 |
| WO | 2020225315 A1 | 11/2020 | | |
| WO | 2022148837 A2 | 7/2022 | | |

OTHER PUBLICATIONS

International Preliminary Report on Patentability issued in Application No. PCT/EP2023/050055, dated Apr. 24, 2024, 16 pages.
Kotaro Ogura et al., "Catalytic Reduction of CO[sub 2] to Ethylene by Electrolysis at a Three-Phase Interface", Journal of the Electrochemical Society, (Jul. 10, 2003), vol. 150, No. 9, p. D163-D168.
Ozden A, et al., "Cascade CO2 electroreduction enables efficient carbonate-free production of ethylene", Joule 5, 2021, 5, 706-719.
Küngas R. "Review-Electrochemical CO2 Reduction for CO Production: Comparison of Low- and High-Temperature Electrolysis Technologies", J. Electrochem. Soc., 2020, 167, 044508, 12 pages.
Ozden A. et al., "High-Rate and Efficient Ethylene Electrosynthesis Using a Catalyst/Promoter/Transport Layer", ACS Energy Lett., 2020, 5, 2811-2818.
Li F., et al., "Molecular tuning of CO2-to-ethylene conversion", Nature, 2020, vol. 577, 509-513.
Huan T. N. et al., "A Dendritic Nanostructured Copper Oxide Electrocatalyst for the Oxygen Evolution Reaction", Angew. Chem. Int. Ed., 2017, 56, 1-6.
Donald S. Ripatti et al., "Carbon Monoxide Gas Diffusion Electrolysis that Produces Concentrated C2 Products with High Single-Pass Conversion", Joule 3, 2019, 240-256.
Adele Peugeot et al., "Benchmarking of oxygen evolution catalysts on porous nickel supports", Joule 5, 1281-1300 (2021).
David Wakerley et al., "Bio-inspired hydrophobicity promotes CO2 reduction on a Cu surface", Nat. Mater. 18, 1222-1227, 2019.
Rodríguez-Carvajal, J., "Recent advances in magnetic structure determination by neutron powder diffraction", Physica B Condens. Matter 192, 55-69, 1993.

* cited by examiner

ELECTROCHEMICAL CARBON OXIDES REDUCTION TO ETHYLENE

CROSS-REFERENCE TO RELATED APPLICATIONS

This application claims the benefit of PCT/EP2023/050055 filed Jan. 3, 2023, which claims priority from EP 22315009.5 filed Jan. 10, 2022 and EP 22182561.5 filed Jul. 1, 2022, which are incorporated herein by reference in their entireties for all purposes.

TECHNOLOGICAL FIELD

The present disclosure relates to an electrolyser for CO and/or $CO_2$ electroreduction, and to process using such an electrolyser to produce at least C2 hydrocarbons.

TECHNOLOGICAL BACKGROUND

Electrochemical carbon dioxide reduction ($CO_2R$) offers an attractive route to upgrade greenhouse gases such as $CO_2$ to valuable fuels and feedstocks. However, today it is curtailed at least in part by the limits of having a high selectivity into specific products. Achieving a narrow product distribution with cheap $CO_2R$ catalysts is challenging and conventional material modifications offer limited control.

Ethylene is the most important organic precursor of the chemical industry used mainly for the production of polyethylene. It is synthesized, with a worldwide production of about 180 million tons per year, typically by steam cracking of a wide range of fossil hydrocarbon feedstocks, a process emitting $CO_2$ and increasing its concentration in the atmosphere. Thus, it is desirable to develop alternatives for the production of non-fossil ethylene. Selective $CO_2$ or CO electroreduction to ethylene using renewable energy sources, while challenging, is one of the most attractive possibilities.

So far, the high production rates (current densities) and selectivities (Faradic efficiencies) for $CO_2$ electroreduction to ethylene have been achieved using gas-fed alkaline flow cells and gas-diffusion cathodes (GDCs) on which Cu-based materials are deposited. This is the consequence of three combined properties: (i) Cu is unique in activating $CO_2$ for C—C coupling; (ii) highly alkaline conditions provide high conductivity, favor $C_2$ products formation and limit $H_2$ evolution; (iii) GDCs are designed to improve $CO_2$ mass transport by maximizing the access of gaseous $CO_2$ to the catalyst active sites in contact with the electrolyte. However, such alkaline flow cell systems greatly suffer from the formation of carbonate/bicarbonate via the reaction between $OH^-$ in the alkaline electrolyte and $CO_2$ at the gas-electrolyte interphase. This results in unproductive $CO_2$ consumption, degradation of the electrolyte, instability of the electrochemical system as well as in extra costs associated with recovery and recycling of the electrolyte.

A strategy to limit the problem of $CO_2$ loss and carbonate formation resides in shifting from single step to tandem $CO_2$ electroreduction, involving a first step of $CO_2$ conversion to CO followed by CO conversion to ethylene. Ozden A, et al. (Joule, 2021, 5, 706-719) showed that the direct transformation of $CO_2$-to-$C_2H_4$ suffers from $CO_2$ loss to carbonate, consuming up to 72% of energy input and suggested a cascade approach wherein a solid-oxide $CO_2$-to-CO electrochemical cell (SOEC) was coupled with a CO-to-$C_2H_4$ membrane electrode assembly (MEA).

For the trends to start directly from $CO_2$, catholyte-free membrane electrode assemblies (MEAs) have been developed for $CO_2$ reduction. In such electrolysers, there is no liquid electrolyte between the catalyst layer, deposited on a gas diffusion layer (GDL), and the ion-exchange membrane. In so-called zero-gap MEAs, the cathodic material is thus directly in contact with the membrane and humidified $CO_2$ gas diffuses through the GDL to the catalyst layer, while the anodic material is directly deposited on the other side of the membrane where it is fed with a circulating anolyte. MEAs have been developed mainly because they potentially avoid the high ohmic losses associated with the electrolyte layers, attenuate electrode flooding at high current densities and catalyst fouling by electrolyte impurities and limit carbonate formation and $CO_2$ crossover from the cathodic to the anodic compartment. Nevertheless, some carbonate/bicarbonate salt formation on the cathode still occurs, requesting further innovations.

The study of Ozden A. et al. (*ACS Energy Lett.,* 2020, 5, 2811-2818) also relates to $CO_2$ electroreduction into ethylene using a catalyst with an adlayer made of an ionomer and tetra-hydro-phenanthrolinium which increases both the local $CO_2$ availability and the adsorption of key intermediate CO on the catalyst surface. This system has allowed obtaining a Faradaic Efficiency of 66% at a partial current density of 208 $mA/cm^2$.

The study of Li F., et al. (*Nature,* 2020, 577, 509-513) relates to the electrocatalytic reduction of $CO_2$ powered by renewable electricity to produce valuable fuels and feedstocks. The functionalization of the surface of electrocatalysts with organic molecules, in particular with arylpyridinium, to stabilize intermediate for more selective $CO_2$ reduction reaction to ethylene has allowed obtaining a Faradaic Efficiency of 72% at a partial current density of 230 $mA/cm^2$ in a liquid-electrolyte flow cell in a neutral medium.

Several other systems to electrochemically reduce $CO_2$ into CO with a Faradaic efficiency of 100% at a partial current density of 200±30 $mA/cm^2$ have been reported in the review by Küngas R (*J. Electrochem. Soc.,* 2020, 167, 044508).

There is still a need to find a way to enhance the electrochemical reduction of $CO_2$ and/or CO to upgrade the greenhouse gases conversion to valuable fuels and feedstocks.

SUMMARY OF THE DISCLOSURE

It has now been found that one or more of the above needs can be fulfilled by the use of an electrolyser comprising a dendritic copper oxide catalyst or a dendritic copper catalyst in a process for electrolysing carbon monoxide into one or more hydrocarbons, and in particular into ethylene.

According to a first aspect, the disclosure provides a process for electrolysing one or more carbon oxides into one or more hydrocarbons, and in particular into ethylene, remarkable in that the process comprises the following steps:

b) preparing a cathode catalyst by electrodeposition of Cu on a Cu electrode from an acidic $CuSO_4$ solution;

c) providing an electrolyser comprising a gas diffusion cathode, an anode and an ion-exchange membrane in between said gas diffusion cathode and said anode, wherein the electrolyser is selected from a zero-gap electrolyser, a two-gaps electrolyser, a catholyte-free one-gap electrolyser and a catholyte-containing one-gap electrolyser, and wherein the ion-exchange membrane is an anion-exchange membrane or a bipolar membrane;

d) providing an input flow at the gas diffusion cathode, the input flow comprising one or more carbon oxides selected from carbon monoxide or a mixture of carbon monoxide and carbon dioxide;

e) providing an anolyte solution at the anode and optionally a catholyte solution at the gas diffusion cathode;

f) applying an electric current between the gas diffusion cathode and the anode; and g) recovering, at the gas diffusion cathode, an output flow comprising one or more hydrocarbons comprising ethylene;

and in that the electrolyser provided at step (c) further comprises a first interface in between the gas diffusion cathode and the ion-exchange membrane, the first interface comprising a cathode catalyst being a dendritic copper oxide catalyst or a dendritic copper catalyst.

The dendritic copper oxide catalyst and the dendritic copper catalyst show a dendrite morphology evidenced by scanning electron microscopy.

For example, the one or more hydrocarbons are ethylene.

It was found that high selectivity to ethylene is obtained for an input flow comprising either CO or a mixture of CO and $CO_2$. Surprisingly, it was found that the presence of CO in the input flow was found to increase the selectivity to ethylene. In particular high selectivity to ethylene was obtained for an input flow that is CO-rich.

In a preferred embodiment, the input flow provided in step (d) comprises one or more carbon oxides selected from carbon monoxide or a mixture of carbon monoxide and carbon dioxide, and wherein the input flow comprises carbon monoxide at a content of at least 30 mol. % or at least 60 mol. % of carbon monoxide based on the total molar content of the carbon oxides present in the input flow.

Surprisingly, highly selective production of ethylene can be achieved via CO reduction using a dendritic copper oxide catalyst (D-CuO) or a dendritic copper catalyst (D-Cu). The integration of such a catalyst into an electrolyser results in the most selective system reported so far for ethylene production from CO reduction at a current density above 0.1 $A \cdot cm^{-2}$.

More specifically, CO reduction yielded ethylene with a Faradaic Efficiency (FE) up to 78%, at 100-125 $mA/cm^2$ with $H_2$ as the only other gaseous product and the electrolysis can be out for several hours with good stability.

For example, the anode comprises an anode catalyst that is or comprises one or more selected from $IrO_2$, nickel foam and nickel-iron oxide.

For example, the electrolyser is a zero-gap electrolyser or a two-gap electrolyser.

In an embodiment, the process further comprises a step (b) of preparing a cathode catalyst by electrodeposition of Cu on a Cu electrode from an acidic $CuSO_4$ solution; with preference, the acidic $CuSO_4$ solution contains $CuSO_4$ at a concentration ranging from 0.05 to 0.5 M and $H_2SO_4$ at a concentration ranging from 0.5 to 3.0 M; more preferably, the acidic $CuSO_4$ solution contains $CuSO_4$ at a concentration ranging from 0.08 to 0.3 M and/or and $H_2SO_4$ at a concentration ranging from 1.3 to 2.5 M.

With preference, step (b) of preparing a cathode catalyst by electrodeposition of Cu is performed at a current ranging from 0.05 $A \cdot cm^{-2}$ to 5.0 $A \cdot cm^{-2}$ for a time ranging from 20 to 500 seconds; more preferably the electrodeposition of Cu is performed at a current ranging from 0.1 $A \cdot cm^{-2}$ to 3.0 $A \cdot cm^{-2}$ and/or for a time ranging from 20 to 200 seconds.

For example, step (b) of preparing a cathode catalyst by electrodeposition of Cu is devoid of a calcination sub-step or comprise a calcination sub-step performed at a temperature below 300° C. With preference, step (b) of preparing a cathode catalyst by electrodeposition of Cu is devoid of a calcination sub-step to obtain a dendritic copper catalyst and/or the dendritic copper catalyst consist of copper and comprises Cu (111) as determined by XRD.

For example, step (b) of preparing a cathode catalyst by electrodeposition of Cu comprises a calcination sub-step performed at a temperature of at least 300° C. to obtain a dendritic copper oxide catalyst and/or the cathode catalyst is a dendritic copper oxide catalyst and comprises CuO (111) as determined by XRD. For example, step (b) of preparing a cathode catalyst comprises a calcination sub-step performed at a temperature of at least 300° C. and the dendritic copper oxide catalyst is devoid of Cu (111) as determined by XRD.

For example, the cathode catalyst is a dendritic copper catalyst that consists of copper and comprises C u(111) as determined by XRD or the cathode catalyst is a dendritic copper oxide catalyst consist of copper and comprises CuO (111) as determined by XRD.

Advantageously, the cathode catalyst is a porous dendritic material and shows pores with a pore size ranging from 100 nm and 500 μm.

Advantageously, the gas diffusion cathode and/or the anode have a surface area up to 4 $cm^2$.

Advantageously, the cathode catalyst is selected to have an electroactive surface area (ECSA) of at least 10 $cm^2$ $cm^{-2}$; preferably, at least 12 $cm^2$ $cm^{-2}$; preferably, at least 15 $cm^2$ $cm^{-2}$.

For example, the cathode catalyst is selected to have an electroactive surface area (ECSA) ranging from 10 $cm^2$ $cm^{-2}$ to 30 $cm^2$ $cm^{-2}$; preferably, from 12 $cm^2$ $cm^{-2}$ to 27 $cm^2$ $cm^{-2}$; more preferably, from 15 $cm^2$ $cm^{-2}$ to 25 $cm^2$ $cm^{-2}$.

Advantageously, the gas diffusion layer of the gas diffusion cathode is hydrophobic. For example, the gas diffusion layer is in porous carbon and is coated with a microporous carbon layer.

With preference, the anolyte solution provided at step (e) is an aqueous solution of one or more alkaline compounds. With preference, the one or more alkaline compounds selected from KOH, NaOH, $Ca(OH)_2$, LiOH, $Mg(OH)_2$, RbOH, CsOH and any mixture thereof, more preferably, the one or more alkaline compounds are or comprise KOH. With preference, the concentration of the one or more alkaline compounds in the aqueous solution is ranging from 0.1 M to 7.0 M; preferably, from 0.5 M to 6.0 M; more preferably from 1.0 to 5.0 M or from 1.5 to 4.5 from 0.1 M to 2.0 M; or from 0.5 M to 1.0 M.

When present, the catholyte solution provided at step (e) is preferably an aqueous solution of one or more alkaline compounds. With preference, the one or more alkaline compounds selected from KOH, NaOH, $Ca(OH)_2$, LiOH, $Mg(OH)_2$, RbOH, CsOH and any mixture thereof, more preferably, the one or more alkaline compounds are or comprise KOH. With preference, the concentration of the one or more alkaline compounds in the aqueous solution is ranging from 0.1 M to 7.0 M; preferably, from 0.5 M to 6.0 M; more preferably from 1.0 to 5.0 M or from 1.5 to 4.5 from 0.1 M to 2.0 M; or from 0.5 M to 1.0 M.

Advantageously, the input flow comprising carbon oxide provided at step (d) has a flow rate ranging from 20 ml/min to 60 ml/min, preferably from 30 ml/min to 50 ml/min.

For example, the electric current applied between the gas diffusion cathode and the anode at step (f) has a current density ranging from 25 $mA/cm^2$ to 300 $mA/cm^2$; preferably from 50 $mA/cm^2$ to 250 $mA/cm^2$; more preferably from 100 $mA/cm^2$ to 200 $mA/cm^2$ Advantageously, the electrolyser is a zero-gap electrolyser or a catholyte-free one-gap electrolyser and the input flow comprising one or more carbon oxides is passed through a water tank before being provided to the gas diffusion cathode. For example, the input flow comprising carbon oxide is passed during at most the first 20 minutes of the electrolysis through a water tank before being provided to the gas diffusion cathode.

For example, the electric current that is applied at step (f) has an electric potential which is ranging from 2.5 to 4.5 V, preferably from 2.8 V to 3.7 V.

For example, the input flow provided in step (d) comprises carbon monoxide at a content of at least 1 mol. % of carbon monoxide based on the total molar content of the carbon oxides present in the input flow; preferably, at least 5 mol. %; preferably, at least 10 mol. %; preferably, at least 15 mol. %; preferably, at least 20 mol. %; preferably, at least 25 mol. %; preferably, at least 30 mol. %; preferably, at least 35 mol. %; preferably, at least 40 mol. %; preferably, at least 45 mol. %; preferably, at least 50 mol. %; preferably, at least 55 mol. %; preferably, at least 60 mol. %; preferably, at least 65 mol. %; preferably, at least 70 mol. %; preferably, at least 75 mol. %; preferably, at least 80 mol. %; preferably, at least 85 mol. %; preferably, at least 90 mol. %.

In an embodiment, the process is a tandem carbon dioxide electroreduction process and comprises a step (a) comprising providing a feedstream comprising carbon dioxide and performing a preliminary conversion of at least a part of the carbon dioxide of said feedstream into carbon monoxide to obtain an input flow comprising at least 1 mol. % of carbon monoxide based on the total molar content of the carbon oxides present in the input flow, wherein said input flow is the one provided in step (d); with preference, the conversion of carbon dioxide into carbon monoxide is performed through an electoreduction reaction or a water-gas shift reaction; with preference, to obtain an input flow comprising at least 30 mol. % or at least 60 mol. % of carbon monoxide based on the total molar content of the carbon oxides present in the input flow.

For example, the preliminary conversion of carbon dioxide into carbon monoxide is performed through an electoreduction reaction using a high-temperature electrolyser or a low-temperature electrolyser; with preference, using a high-temperature electrolyser comprising a high-temperature solid oxide electrolysis cell.

Advantageously, the output flow recovered at step (g) further comprises one or more of hydrogen, ethanol and/or n-propanol.

According to a second aspect, the disclosure provides an electrolyser suitable for a process for electrolysing carbon monoxide or a mixture of carbon monoxide and carbon dioxide into one or more hydrocarbons wherein the process is according to the first aspect, wherein the electrolyser is selected from a zero-gap electrolyser, a two-gap electrolyser, a catholyte-free one-gap electrolyser and a catholyte-containing one-gap electrolyser, wherein the electrolyser comprises a gas diffusion cathode, an anode and ion-exchange membrane in between said gas diffusion cathode and said anode, wherein the ion-exchange membrane is an anion-exchange membrane or a bipolar membrane, and wherein the electrolyser comprises a first interface placed between the gas diffusion cathode and the ion-exchange membrane, the first interface comprising a cathode catalyst; wherein the electrolyser is remarkable in that the cathode catalyst is a dendritic copper oxide catalyst or a dendritic copper catalyst.

For example, the electrolyser is a zero-gap electrolyser or a two-gap electrolyser.

According to a third aspect, the disclosure provides the use of a cathode catalyst in an electrolyser for electrolysing carbon monoxide, or a mixture of carbon monoxide and carbon dioxide into one or more hydrocarbons comprising ethylene, wherein the electrolyser comprises a gas diffusion cathode, an anode and an ion-exchange membrane in between said gas diffusion cathode and said anode, wherein the electrolyser is selected from a zero-gap electrolyser, a two-gaps electrolyser, a catholyte-free one-gap electrolyser and a catholyte-containing one-gap electrolyser, and wherein the ion-exchange membrane is an anion-exchange membrane or a bipolar membrane, the use is remarkable in that the cathode catalyst is a dendritic copper oxide catalyst or a dendritic copper catalyst.

The particular features, structures, characteristics or embodiments may be combined in any suitable manner, as would be apparent to a person skilled in the art from this disclosure, in one or more embodiments.

DETAILED DESCRIPTION

Figure 1:
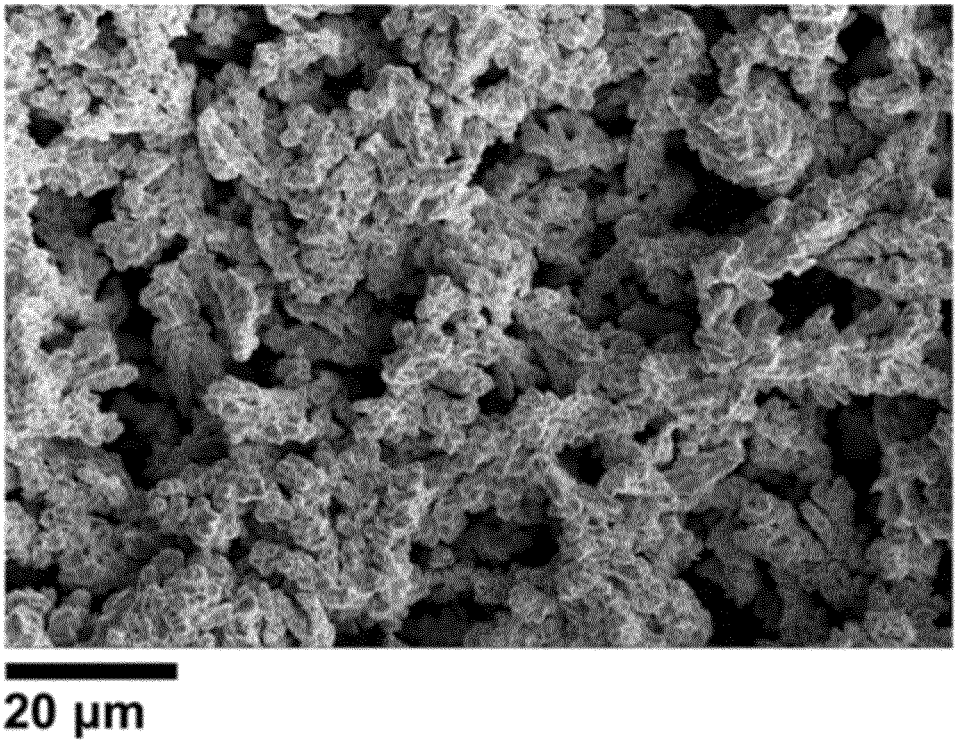
FIG. 1 is a scanning electron microscopy (SEM) image of the porous and dendritic structure of the dendritic copper oxide catalyst used at the cathode of the electrolyser of the present disclosure.

For the disclosure, the following definitions are given:

The terms "comprising", "comprises" and "comprised of" as used herein are synonymous with "including", "includes" or "containing", "contains", and are inclusive or open-ended and do not exclude additional, non-recited members, elements or method steps. The terms "comprising", "comprises" and "comprised of" also include the term "consisting of".

The recitation of numerical ranges by endpoints includes all integer numbers and, where appropriate, fractions subsumed within that range (e.g. 1 to 5 can include 1, 2, 3, 4, 5 when referring to, for example, a number of elements, and can also include 1.5, 2, 2.75 and 3.80, when referring to, for example, measurements). The recitation of endpoints also includes the recited endpoint values themselves (e.g. from 1.0 to 5.0 includes both 1.0 and 5.0). Any numerical range recited herein is intended to include all sub-ranges subsumed therein.

The disclosure provides a process and an electrolyser to be used in such a process. The process and the electrolyser will therefore be described jointly.

The process for electrolysing one or more carbon oxides into one or more hydrocarbons comprises the following steps:

b) preparing a cathode catalyst by electrodeposition of Cu on a Cu electrode from an acidic $CuSO_4$ solution;

c) providing an electrolyser comprising a gas diffusion cathode, an anode and an ion-exchange membrane in between said gas diffusion cathode and said anode, wherein the electrolyser is selected from a zero-gap electrolyser, a two-gaps electrolyser, a catholyte-free one-gap electrolyser and a catholyte-containing one-gap electrolyser, and wherein the ion-exchange membrane is an anion-exchange membrane or a bipolar membrane;

d) providing an input flow at the gas diffusion cathode, the input flow comprising one or more carbon oxides selected from carbon monoxide, or a mixture of carbon monoxide and carbon dioxide;

e) providing an anolyte solution at the anode and optionally a catholyte solution at the gas diffusion cathode;

f) applying an electric current between the gas diffusion cathode and the anode; and g) recovering at the gas diffusion cathode, an output flow comprising one or more hydrocarbons wherein the one or more hydrocarbons are or comprise ethylene;

and wherein the electrolyser provided at step (c) further comprises a first interface in between the gas diffusion cathode and the ion-exchange membrane, the first interface comprising a cathode catalyst that is a dendritic copper oxide catalyst or a dendritic copper catalyst.

In a preferred embodiment, the input flow provided in step (d) comprises one or more carbon oxides selected from carbon monoxide or a mixture of carbon monoxide and carbon dioxide, and wherein the input flow comprises carbon monoxide at a content of at least 30 mol. % or at least 60 mol. % of carbon monoxide based on the total molar content of the carbon oxides present in the input flow The dendritic copper oxide catalyst and the dendritic copper catalyst both show a dendrite morphology evidenced by scanning electron microscopy.

The process may comprise optional steps of preparing the cathode catalyst and/or performing a preliminary conversion of $CO_2$ to CO. Thus, the process for electrolysing one or more carbon oxides into one or more hydrocarbons may comprise the following steps:

a) optionally, providing a feedstream comprising carbon dioxide and performing a preliminary conversion of at least a part of the carbon dioxide of said feedstream into carbon monoxide to obtain an input flow comprising carbon monoxide wherein the input flow comprising carbon monoxide is the one provided in step (d);

b) preparing a cathode catalyst by electrodeposition of Cu on a Cu electrode from an acidic $CuSO_4$ solution;

c) providing an electrolyser comprising a gas diffusion cathode (GDC), an anode (GDA) and an ion-exchange membrane (IEM) in between said gas diffusion cathode and said anode, wherein the electrolyser is selected from a zero-gap electrolyser, a two-gaps electrolyser, a catholyte-free one-gap electrolyser and a catholyte-containing one-gap electrolyser, and wherein the ion-exchange membrane is an anion-exchange membrane or a bipolar membrane;

d) providing an input flow at the gas diffusion cathode, the input flow comprising one or more carbon oxides selected from carbon monoxide or a mixture of carbon monoxide and carbon dioxide; and wherein the input flow comprises carbon monoxide at a content of at least 1 mol. % of carbon monoxide based on the total molar content of the carbon oxides present in the input flow;

e) providing an anolyte solution at the anode and optionally a catholyte solution at the gas diffusion cathode;

f) applying an electric current between the gas diffusion cathode and the anode; and g) recovering at the gas diffusion cathode, an output flow comprising one or more hydrocarbons wherein the comprising one or more hydrocarbons are or comprise ethylene;

and wherein the electrolyser provided at step (c) further comprises a first interface in between the gas diffusion cathode and the ion-exchange membrane, the first interface comprising a cathode catalyst that shows a dendrite morphology evidenced by scanning electron microscopy and is a dendritic copper oxide catalyst or a dendritic copper catalyst.

With preference, the input flow provided in step (d) comprises one or more carbon oxides selected from carbon monoxide or a mixture of carbon monoxide and carbon dioxide, and wherein the input flow comprises carbon monoxide at a content of at least 30 mol. % or at least 60 mol. % of carbon monoxide based on the total molar content of the carbon oxides present in the input flow. Advantageously, the output flow recovered at step (g) further comprises hydrogen, ethanol and/or n-propanol.

The Cathode Catalyst and the Optional Step (b) of Preparation of the Cathode Catalyst The process may comprise the preparation of the cathode catalyst. The cathode catalyst according to the present disclosure is a dendritic copper oxide catalyst or a dendritic copper catalyst; therefore, the cathode catalyst shows a dendrite morphology evidenced by scanning electron microscopy.

In a preferred embodiment, the cathode catalyst is prepared by electrodeposition of Cu on a Cu electrode from an acidic $CuSO_4$ solution wherein the acidic $CuSO_4$ solution contains $H_2SO_4$ at a concentration ranging from 0.5 to 3.0 M; preferably, from 1.3 to 2.5 M.

In a preferred embodiment, the cathode catalyst is prepared by electrodeposition of Cu on a Cu electrode from an acidic $CuSO_4$ solution wherein the acidic $CuSO_4$ solution contains $CuSO_4$ at a concentration ranging from 0.05 to 0.5 M; preferably, from 0.08 to 0.3 M.

A calcination sub-step may be performed or not. In an embodiment, step (b) of preparing a cathode catalyst is devoid of a calcination sub-step or comprise a calcination sub-step performed at a temperature below 300° C. With preference, step (b) of preparing a cathode catalyst is devoid of a calcination sub-step and the dendritic copper catalyst consist of copper and comprises Cu (111) as determined by XRD. In a preferred embodiment, the copper is or comprises Cu (111). As known to the person skilled in the art, the Cu (111) is a Cu single crystal with (111) facet exposed.

In an embodiment, the step (b) of preparing a cathode catalyst comprises a calcination sub-step performed at a temperature of at least 300° C., preferably at least 350° C., or at least 400° C. or at least 450° C. or at least 500° C.

With preference, step (b) of preparing a cathode catalyst comprises a calcination sub-step performed at a temperature of at least 300° C. and the dendritic copper oxide catalyst comprises CuO (111) as determined by XRD. For example, step (b) of preparing a cathode catalyst comprises a calcination sub-step performed at a temperature of at least 300° C. and the dendritic copper oxide catalyst comprises is devoid of Cu(111) as determined by XRD In an embodiment, the dendritic copper oxide (D-CuO) catalyst is prepared according to the method reported in the study of Huan T. N. et al., *Angew. Chem. Int. Ed.,* 2017, 56, 4792-4796 (see the preparation of material 3) which is enclosed herein by reference.

Whatever calcination is performed or not, the dendritic copper oxide is a porous dendritic material and shows pores with a pore size ranging from 100 nm and 500 μm.

Advantageously, the cathode catalyst is selected to have an electroactive surface area (ECSA) of at least 10 $cm^2$ $cm^{-2}$; preferably, at least 12 $cm^2$ $cm^{-2}$; preferably, at least 15 $cm^2$ $cm^{-2}$.

For example, the cathode catalyst is selected to have an electroactive surface area (ECSA) ranging from 10 $cm^2$ $cm^{-2}$ to 30 $cm^2$ $cm^{-2}$; preferably, from 12 $cm^2$ $cm^{-2}$ to 27 $cm^2$ $cm^{-2}$; more preferably, from 15 $cm^2$ $cm^{-2}$ to 25 $cm^2$ $cm^{-2}$; even more preferably, from 15 $cm^2$ $cm^{-2}$ to 22 $cm^2$ $cm^{-2}$.

For example, the cathode catalyst is prepared by electrodeposition of Cu on a Cu electrode from an acidic $CuSO_4$ solution wherein the acidic CuSO4 solution contains $H_2SO_4$ at a concentration ranging from 1.3 to 2.5 M and the cathode catalyst has an electroactive surface area (ECSA) ranging from 15 $cm^2$ $cm^{-2}$ to 25 $cm^2$ $cm^{-2}$; preferably from 15 $cm^2$ $cm^{-2}$ to 22 $cm^2$ $cm^{-2}$.

The Electrolyser and the Step (c) of Providing Such an Electrolyser.

For example, the first interface of the membrane electrode assembly further comprises a first gas diffusion layer (GDL) wherein the dendritic copper oxide catalyst or the dendritic copper catalyst forms a cathode catalyst layer deposited on the first gas diffusion layer, the electrolyser has a second interface between the anode and the anion-exchange membrane, the second interface comprising a second gas diffusion layer and an anode catalyst layer, the anode catalyst layer being deposited on the second gas diffusion layer; with preference, the anode catalyst layer is selected from $IrO_2$, nickel foam and nickel-iron oxide.

For example, at least one gas diffusion layer is in porous carbon and is coated with a microporous carbon layer.

The gas diffusion layer (GDL) is a hydrophobic layer and consists, for example, of hydrophobic macro/mesoporous carbon fiber-based fabrics coated with a hydrophobic microporous layer, on which the catalyst layer is deposited. The whole structure allows a homogeneous gas distribution within the gas diffusion layer and at the catalyst layer interface, and the high porosity of the catalyst layer allows maximizing gas diffusion over to the catalytic active sites.

Figure 13:
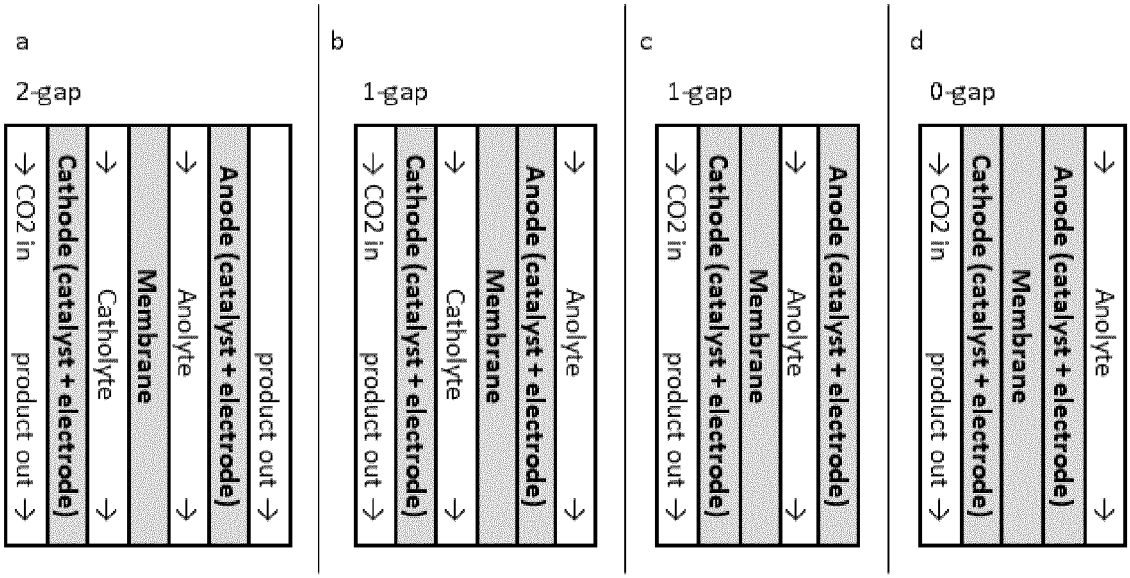
FIG. 13 illustrates the different configurations of electrolyzers.

The electrolyser is selected from a zero-gap electrolyser, a two-gap electrolyser, a catholyte-free one-gap electrolyser and a catholyte-containing one-gap electrolyser. The different configurations are illustrated in FIG. 13.

In the cases the electrolyser is a zero-gap electrolyser (FIG. 13*d*) or a catholyte-free one-gap electrolyser (FIG. 13*c*), then the first interface further comprises a gas diffusion layer with the cathode catalyst being deposited as a layer on the gas diffusion layer and the electrolyser is devoid of catholyte solution between the catalyst layer so that the ion-exchange membrane and the cathode catalyst layer is in contact with the ion-exchange membrane. In such cases, the protons required for $CO_2$/CO reduction mainly come from water that diffuses from the anolyte through the membrane. However, at the beginning of the electrolysis reaction, when there was not enough water accessible, the gas substrate is preferably humidified. Thus, with preference, the input flow comprising one or more carbon oxides is passed through a water tank before being provided to the gas diffusion cathode. For example, the input flow is passed through a water tank during at most the first 20 minutes of the electrolysis through a water tank before being provided to the gas diffusion cathode.

In the cases the electrolyser is a zero-gap electrolyser (FIG. 13*d*) or a catholyte-containing one-gap electrolyser (FIG. 13*b*), then the second interface further comprises a gas diffusion layer with the anode catalyst being deposited as a layer on the gas diffusion layer and the electrolyser is devoid of anolyte solution between the catalyst layer so that the ion-exchange membrane and the anode catalyst layer is in contact with the ion-exchange membrane. These two configurations are anolyte-free configurations.

In the case wherein the electrolyser is a two-gap electrolyser (FIG. 13*a*) none of the cathode catalyst layer and anode catalyst layer is in contact with the ion-exchange membrane.

The ion exchange membrane is an anion-exchange membrane (AEM) or a bipolar membrane (BPM). Both types of membranes are well-known to the person skilled in the art. Anion-exchange membranes (AEMs) are semipermeable membranes designed to conduct anions while being impermeable to gases such as oxygen or hydrogen and are generally produced with ionomers. Bipolar membranes (BPMs) are a special class of ion-exchange membranes constituted by a cation- and an anion-exchange layer, allowing the generation of protons and hydroxide ions via a water dissociation mechanism. It is therefore understood that it is important for the electrolyser to have an anion-exchange membrane or at least a membrane with an anion-exchange layer.

It is understood that in all the electrolysers according to the present disclosure such as selected from a zero-gap electrolyser, a two-gaps electrolyser, a catholyte-free one-gap electrolyser and a catholyte-containing one-gap electrolyser, an anolyte solution provided at step (e)

For example, the anolyte solution provided at step (e) is an aqueous solution of one or more alkaline compounds wherein the one or more alkaline compounds are selected from KOH, NaOH, $Ca(OH)_2$, LiOH, $Mg(OH)_2$, RbOH, CsOH and any mixture thereof; preferably, the one or more alkaline compounds are or comprise KOH. With preference, the concentration of the one or more alkaline compounds in the aqueous solution is ranging from 0.1 M to 7.0 M; preferably, from 0.5 M to 6.0 M; more preferably from 1.0 M to 5.0 M or from 1.5 M to 4.5 from 0.1 M to 2.0 M; or from 0.5 M to 1.0 M.

When present, the catholyte solution provided at step (e) is preferably an aqueous solution of one or more alkaline compounds. With preference, the one or more alkaline compounds are selected from KOH, NaOH, $Ca(OH)_2$, LiOH, $Mg(OH)_2$, RbOH, CsOH and any mixture thereof, more preferably, the one or more alkaline compounds are or comprise KOH. With preference, the concentration of the one or more alkaline compounds in the aqueous solution is ranging from 0.1 M to 7.0 M; preferably, from 0.5 M to 6.0 M; more preferably from 1.0 to 5.0 M or from 1.5 to 4.5 from 0.1 M to 2.0 M; or from 0.5 M to 1.0 M.

For example, the electric current applied between the gas diffusion cathode and the anode at step (f) has a current density ranging from 75 $mA/cm^2$ to 200 $mA/cm^2$.

Advantageously, the electric current applied between the gas diffusion cathode and the anode at step (f) has a current density ranging from 25 $mA/cm^2$ to 300 $mA/cm^2$; preferably, from 50 $mA/cm^2$ to 250 $mA/cm^2$; more preferably from 75 $mA/cm^2$ to 200 $mA/cm^2$, even more preferably ranging from 100 $mA/cm^2$ to 200 $mA/cm^2$ or from 100 $mA/cm^2$ to 175 $mA/cm^2$ or from 100 $mA/cm^2$ to 125 $mA/cm^2$ or from 125 $mA/cm^2$ to 150 $mA/cm^2$.

The input flow comprises one or more carbon oxides selected from carbon monoxide, carbon dioxide or a mixture of carbon monoxide and carbon dioxide; and wherein the input flow comprises carbon monoxide at a content of at least 1 mol. % of carbon monoxide based on the total molar content of the carbon oxides present in the input flow. Advantageously, the input flow provided at step (d) has a flow rate ranging from 20 ml/min and 60 ml/min, preferably between 30 ml/min and 50 ml/min.

For example, the input flow provided in step (d) comprises carbon monoxide at a content of at least 1 mol. % of carbon monoxide based on the total molar content of the carbon oxides present in the input flow; preferably, at least 5 mol. %; preferably, at least 10 mol. %; preferably, at least 15 mol. %; preferably, at least 20 mol. %; preferably, at least 25 mol. %; preferably, at least 30 mol. %; preferably, at least 35 mol. %; preferably, at least 40 mol. %; preferably, at least 45 mol. %; preferably, at least 50 mol. %; preferably, at least 55 mol. %; preferably, at least 60 mol. %; preferably, at least 65 mol. %; preferably, at least 70 mol. %; preferably, at least 75 mol. %; preferably, at least 80 mol. %; preferably, at least 85 mol. %; preferably, at least 90 mol. %. In an embodiment; the input flow provided in step (d) comprises at least 30 mol. % of carbon monoxide based on the total molar content of the carbon oxides present in the input flow, for example at least 35 mol. % or at least 40 mol. %, for example at least 45 mol. %.

In a preferred embodiment, the input flow provided in step (d) is CO-rich, this means that the input flow provided in step (d) comprises at least 50 mol. % or more than 50 mol. % of carbon monoxide based on the total molar content of the carbon oxides present in the input flow, for example at least 51 mol. % or at least 55 mol. %, for example at least 60 mol. %.

For example, the input flow provided in step (d) comprises carbon monoxide at a content of at least 80 mol. % of carbon monoxide based on the total molar content of the carbon oxides present in the input flow; preferably, at least 90 mol. %; more preferably at least 95 mol. %; even more preferably at least 99 mol. % or 100 mol. %.

The current density may be adapted according to the carbon oxides present in the input flow. It was found that CO reduction may be performed at a current density lower than the one used for $CO_2$ reduction. For example, in case the input flow is $CO_2$-rich, the electric current applied between the gas diffusion cathode and the anode at step (d) may have a current density ranging from 125 $mA/cm^2$ to 150 $mA/cm^2$. For example, in case the input flow is CO-rich, the electric current applied between the gas diffusion cathode and the anode at step (d) has a current density ranging from 100 $mA/cm^2$ to 125 $mA/cm^2$.

The same was found for the electric potential. While it was observed that the catalytic wave was starting at a potential of 2.0 V, the electric current that is applied at step (d) has preferably an electric potential which is ranging from 2.5 V to 5.0 V, for example from 2.5 V to 4.5V, for example from 2.8 V to 3.7 V.

For example, the anolyte solution provided at step (e) is an aqueous solution of an alkaline compound, and wherein the electric current that is applied at step (f) has an electric potential which is decreasing upon increasing the concentration of the one or more alkaline compounds.

While it was found that high selectivity to ethylene is obtained for an input flow comprising either CO or $CO_2$, a surprising higher selectivity to ethylene was obtained for an input flow that is CO-rich.

The disclosure also provides for a combined process comprising a step (a) of converting $CO_2$ into CO. Such conversion can be done in many ways but is preferably made using a preliminary electroreduction of carbon dioxide into carbon monoxide. Thus, in an embodiment, the process is a tandem $CO_2$ electroreduction involving a step (a) of $CO_2$ conversion to CO followed by a CO conversion to hydrocarbons such as ethylene.

In such a tandem $CO_2$ electroreduction, the process comprises a step (a) comprising providing a feedstream comprising carbon dioxide and performing a preliminary electroreduction of carbon dioxide of said feedstream into carbon monoxide to obtain an input flow comprising carbon monoxide wherein the input flow comprising carbon monoxide is the one provided in step (d). With preference, the conversion of carbon dioxide into carbon monoxide is performed through an electoreduction reaction or a water-gas shift reaction.

Water-gas shift reaction is well known to the person skilled in the art and describes the reaction of carbon monoxide and water vapor to form carbon dioxide and hydrogen:

$$CO+H_2O \rightleftharpoons CO_2+H_2$$

For example, the preliminary conversion of carbon dioxide into carbon monoxide is performed through an electoreduction reaction using a high-temperature electrolyser or a low-temperature electrolyser; with preference, using a high-temperature electrolyser comprising a high-temperature solid oxide electrolysis cell.

The rationale resides in the fact that CO does not react with HO—. Thus, highly alkaline electrolytes, favoring ethylene formation, can be used in the CO electroreduction step. Because of the very low solubility of CO in water, flow electrolysers using GDCs for CO electroreduction have been developed and have resulted in remarkable achievements for ethylene production, with high selectivity at high current densities. The tandem scenario however requests that the $CO_2$ electroreduction step does not degrade $CO_2$ into carbonate too extensively. This is the case for example if a high-temperature solid-oxide electrolysis cell (SOEC) is used for highly efficient and selective $CO_2$ electroreduction to CO, as it avoids carbonate formation, as demonstrated by Ozden A, et al. (Joule, 2021, 5, 706-719). With preference, the preliminary electroreduction of carbon dioxide into carbon monoxide is performed using a high-temperature solid oxide electrolysis cell (SOEC).

The D-CuO/electrolyser may be used in tandem with a $CO_2$ electrolyser so that it would be possible to upgrade considerably the greenhouse gases to valuable fuels and feedstocks. For example, coupling the system described in the review of Küngas R. (*J. Electrochem. Soc.*, 2020, 167, 044508) with the CO electrolyser such as the one described in the present disclosure results in ethylene production with high energy efficacy.

Test Methods

Scanning Electron Microscopy: SEM images were obtained using a Ultra 55 ZEISS.

$^1$H-NMR Spectroscopy

Bruker Advance Ill 300 MHz spectrometer at 300 K has been used. $D_2O$ was used as the lock solvent and an aqueous solution of terephthalic acid (TPA) was used as an internal standard for quantification.

All electrochemical measurements were conducted by a multichannel potentiostat (Bio-Logic VMP3). As for the set-up of the reactor, a D-Cu/GDE, an anion exchange membrane (AEM; Sustainion, X37-50 Grade T, Dioxide Materials) and a Ni foam (Goodfellow, 99.5%) of 1 $cm^2$ were sequentially assembled in a flow cell reactor (Sphere Energy) with some layers of silicon foil placed in between to avoid gas and liquid leakages. A leak-free reference Ag/AgCl (LF-1-45, 1 mm OD, 45 Barrrel, Innovative Instruments) was also connected to the flow cell. Aqueous solutions of KOH 1-7 M prepared from KOH (powder for synthesis, Sigma-Aldrich) were used as electrolytes with a flow rate of 15 $ml \cdot min^{-1}$. CO gas (99.998%, Linde) flow rate was regulated at 20-50 $ml \cdot min^{-1}$. $CO_2$ gas (99.9993%, Linde) flow rate was 20 $ml \cdot min^{-1}$.

CO and $CO_2$ Reduction Product Analysis

Gaseous products: An online gas chromatograph (SRI instruments, MG #5 GC, Ar carrier) was employed to quantify the amounts of generated $C_2H_4$, $H_2$, CO and $CH_4$. Quantification of $H_2$ was performed by a thermal conductivity detector and a HaySepD precolumn attached to a 3 m molecular sieve column was used to separate $H_2$ from the other gases. Quantification of carbon-based products was carried out by a flame-ionization detector. CO and $CH_4$ were separated using a 3 m molecular sieve column. $C_2H_4$ and $C_2H_6$ were separated using a 5 m HaySepD column. The GC was calibrated by using a gas mixture at different concentrations.

Liquid products: The amounts of liquid products were determined by proton nuclear magnetic resonance spectroscopy ($^1$H-NMR; Bruker Avance III 300 MHz, 300 K). 400 μL of reacted catholyte, 100 μL $D_2O$ (Eurisotop, 99.90%) as a locking solvent, and 100 μL of 5 mM aqueous solution of terephthalic acid prepared from terephthalic acid (Sigma-Aldrich, 98%) as a reference were mixed together for the quantification. The water peak from each spectrum43 was eliminated by a Pre-SAT180 water suppression method.

Faradaic efficiencies of the products were calculated by the equation below.

$$FE_X(\%) = \frac{n_x \times n_{e^-x} \times F}{Q} \times 100$$

$n_x$ is the amount of product x (mol), $n_{e^-x}$ is the number of electrons required to generate x from CO, $CO_2$ or $H_2O$, F is the Faraday constant (96500 $C \cdot mol^{-1}$), Q is the charge passed to generate $n_x$.

Characterization of Electrocatalyst

Sample observation was carried out by using scanning electron microscopy (SEM; ZEISS, Ultra 55). Surface elemental composition was determined by X-ray photoelectron spectroscopy (XPS; Thermo Electron Escalab 250) using a monochromated Al Ka radiation (1486.6 eV) and photoelectron take-off angle of 90°. Survey and high-resolution spectra energy were 100 eV and 20 eV, respectively. Thermo Electron software Avantage was used for the curve fitting of the XPS spectra. Cu Auger peaks were deconvoluted by using spectra of pure $Cu_2O$ and Cu standards measured by the same instrument. Before deconvolution, all peaks were corrected by Shirley background. Crystal phases of samples were analyzed by X-ray powder diffraction employing Cu Kα radiation (λKα1=1.54056 Å, λKα2=1.54439 Å) equipped with a Lynxeye detector (XRD; BRUKER D8 Advance diffractometer) in Bragg-Brentano geometry. Analysis of the XRD patterns was performed by using the Rietveld method*.

*FullProf program [Rodrìguez-Carvajal, J. Recent advances in magnetic structure determination by neutron powder diffraction. Physica B Condens. Matter 192, 55-69 (1993), program available at https://www.ill.eu/sites/fullprof/]

ESCA procedure: The ECSA was measured through the capacitance of the electrodes in a 1 M solution of KOH bubbled with Ar (g) beforehand. The capacitance was measured by analysis of the electrode (1 $cm^2$) cyclic voltammogram from 0.7 to 0.9 V (vs RHE) using the flowing equation: (ia−ic)/2=C·v, where C is the capacitance (F), ia is the anodic current (A), ic is the equivalent cathodic current (A) and v is the scan rate ($mV \cdot s^{-1}$). The capacitance was calculated as the slope of the curve made by plotting the equation against scan rate. After that, the ECSA was determined from the ratio between the capacitance of the surfaces relative to a pure Cu surface reference.

EXAMPLES

Example 1

Preparation of the Dendritic Copper Oxide (D-CuO) Catalyst and the Electrolyser

The cathode catalyst was prepared according to the method reported in the study of Huan T. N. et al., *Angew. Chem. Int. Ed.,* 2017, 56, 4792-4796 (see the preparation of material 3)

Figure 2:
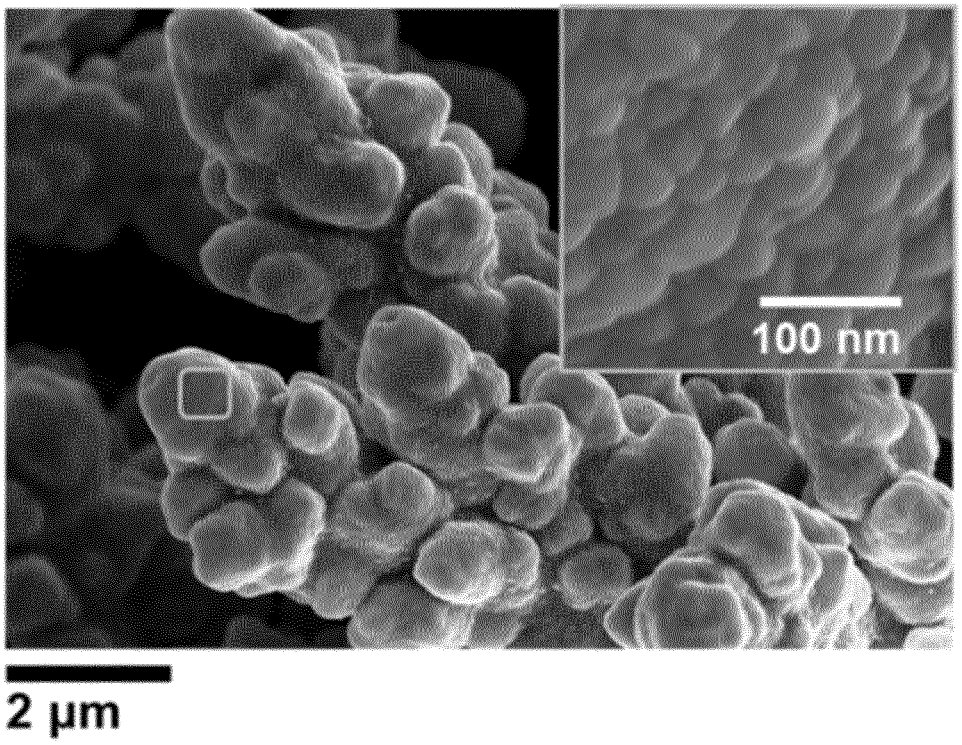
FIG. 2 is an SEM image showing that the surface of the dendrites of the dendritic copper oxide catalyst is covered with a uniform layer of CuO nanoparticles.

First, Cu was electrodeposited on a Cu plate electrode in acidic conditions (1.5 M $H_2SO_4$) under high current density (0.5 $A \cdot cm^{-2}$) allowing the formation of a material with a dendritic porous structure, promoted by the development of $H_2$ bubbles during electrodeposition. Then the deposited material was scratched away from the Cu support and the obtained powder was calcined at 500° C. in ambient air for 2 h, to generate a CuO material. After calcination, the sample was finely ground and dispersed in a solution of ethanol containing Nafion. The resulting ink was then deposited (catalyst loading of ~1 mg $cm^{-2}$) onto a gas diffusion layer (GDL) using the drop-casting method. Characterization of the final material by scanning electron microscopy (SEM) confirmed a porous and dendritic structure (FIG. 1) and showed that the surface of the dendrites was covered with a uniform layer of CuO nanoparticles with a diameter of 30-50 nm (FIG. 2).

Figure 3:
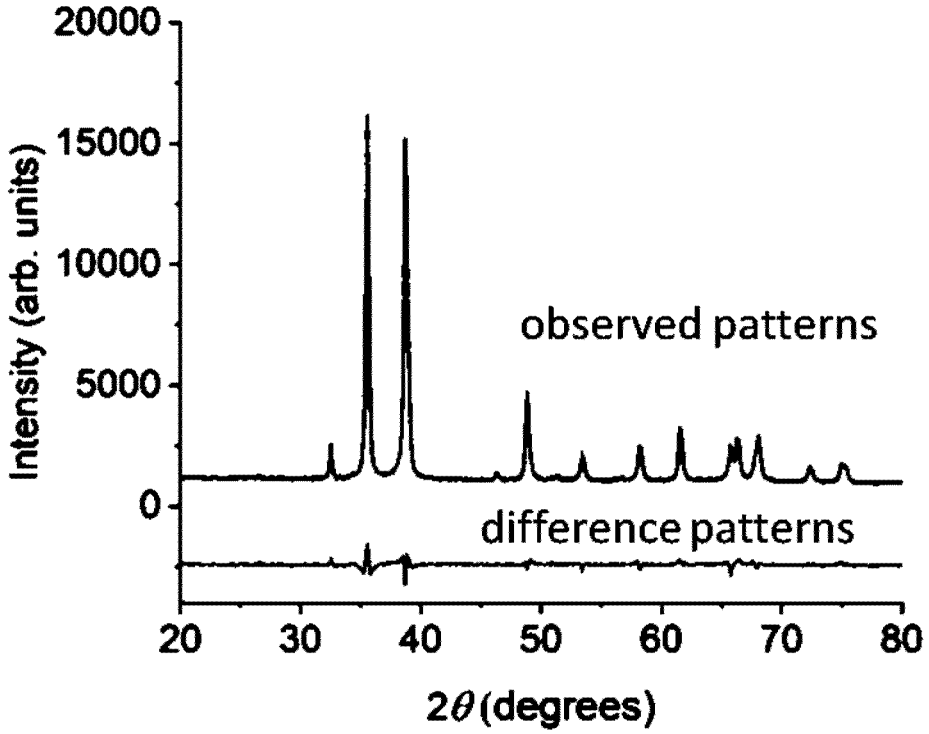
FIG. 3 is the X-Ray Diffraction (XRD) spectrum of the dendritic copper oxide catalyst.
Figure 4:
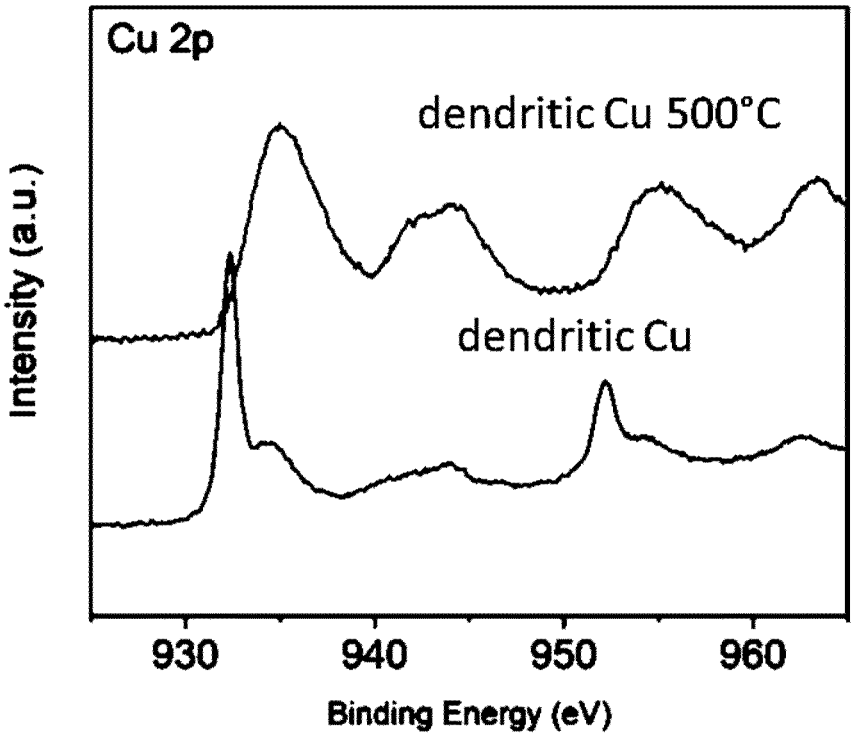
FIG. 4 is the X-Ray Photoelectron Spectroscopy (XPS) spectrum of the dendritic copper oxide catalyst with and without calcination.

The X-ray powder diffraction (XRD) spectrum of D-CuO is presented in FIG. 3, in which the patterns can be indexed with 100% CuO. Via the Rietveld refinement of X-ray powder pattern using observed and calculated spectra (estimation based on the Scherrer equation, FIG. 3 shows the difference between the observed and calculated spectra), the isotropic crystallite size of CuO was estimated to be on average ca. 28 nm. D-CuO X-ray photoelectron spectrometry (XPS) characteristics are also consistent with the XRD data, showing phase transition from metallic Cu to CuO after 2 h calcination at 500° C. (FIG. 4). The XPS spectrum of D-CuO exhibited two peaks at 934.2 eV and 954.8 eV indeed characteristic of the presence of CuO.

Figure 5:
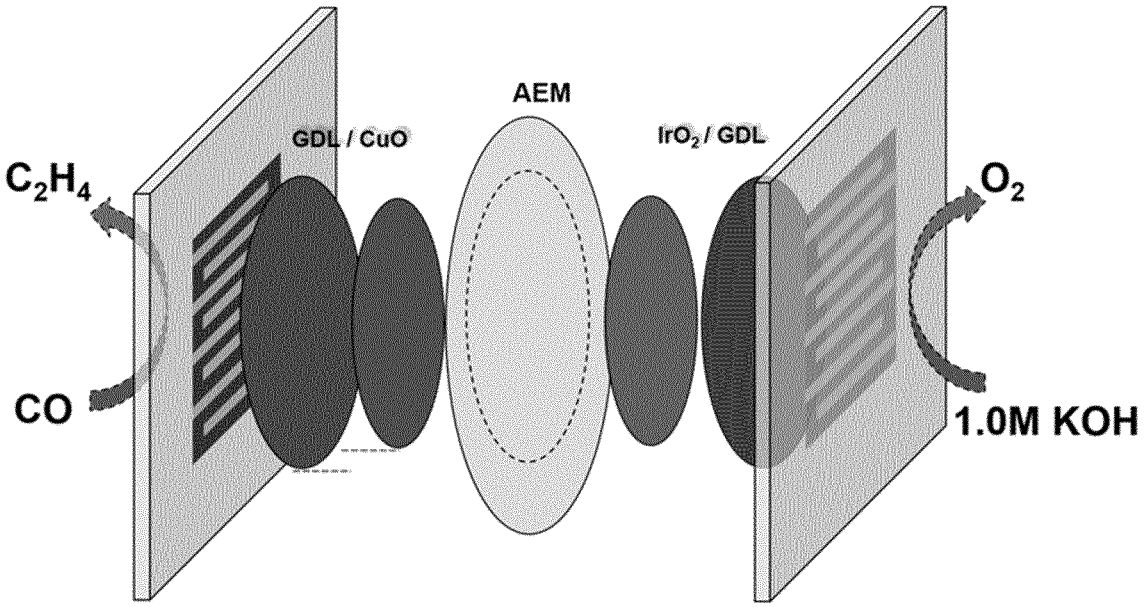
FIG. 5 is a representation of a zero-gap electrolyser of the present disclosure.

The electrolyser (MEA) (FIG. 5) for CO and/or $CO_2$ electroreduction allows the use of high-surface electrodes (up to 4 $cm^2$) and in which ionic transport is mediated by an anion-exchange membrane pressed between the gas diffusion cathode (GDC), fed with a gas ($CO_2$ or CO) flowing to the backside of the cathode, and anode (GDA). For example, the AEM can be Sustainion®. The GDA consists of a hydrophobic GDL on which an $IrO_2$ catalyst is loaded. In this device, no catholyte chamber was present and no catholyte was used, while, on the anode side, a circulating solution of potassium hydroxide (0.1 M-2 M KOH) was supplied to the GDA and the anion-exchange membrane.

During the reaction, the gas is not humidified and protons required for $CO_2$/CO reduction mainly come from water that diffuses from the anolyte through the membrane. However, at the very beginning of electrolysis, when there was not enough water accessible, the gas substrate was humidified (by bubbling through a water tank, at room temperature). After 20 minutes, humidification of the gas stream was stopped while continuing the electrolysis. In that respect, it is important to note that the hydrophobic GDA allows controlling water diffusion to the cathode since an excess of water on the membrane and the cathode would be detrimental to the system. The gas outflow line was equipped with a water trap to collect the liquid-phase products (formic acid, ethanol, n-propanol and acetic acid) present in the gas stream. These products were analyzed by NMR spectroscopy and the gaseous products were analyzed by GC-on line measurements.

CO Electroreduction

Figure 6:
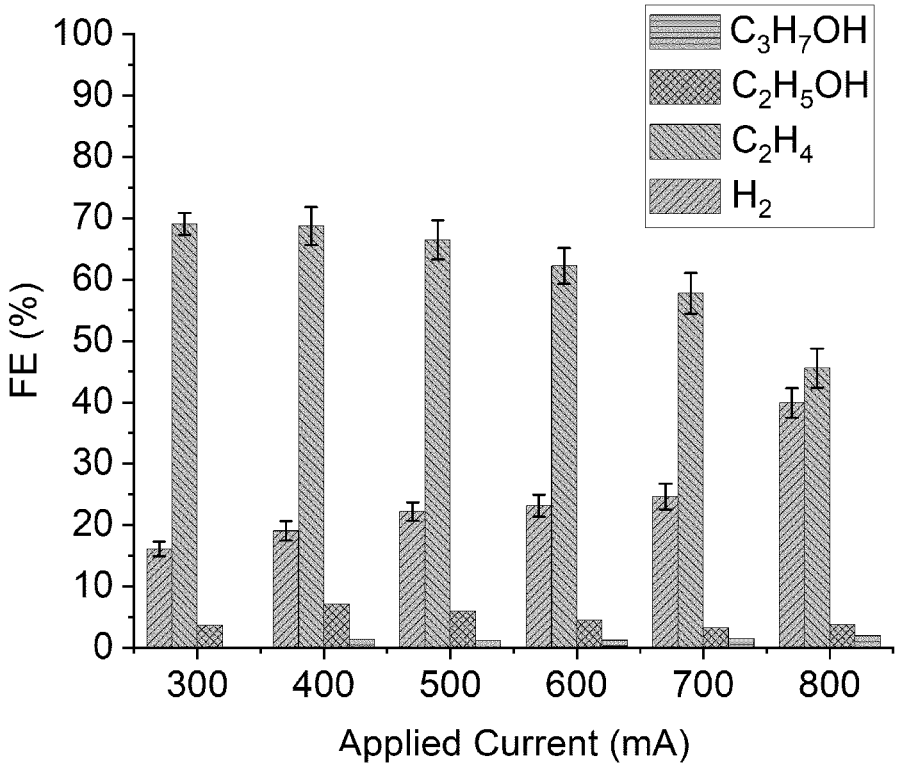
FIG. 6 CO reduction by using a one-gap electrolyzer.
Figure 7:
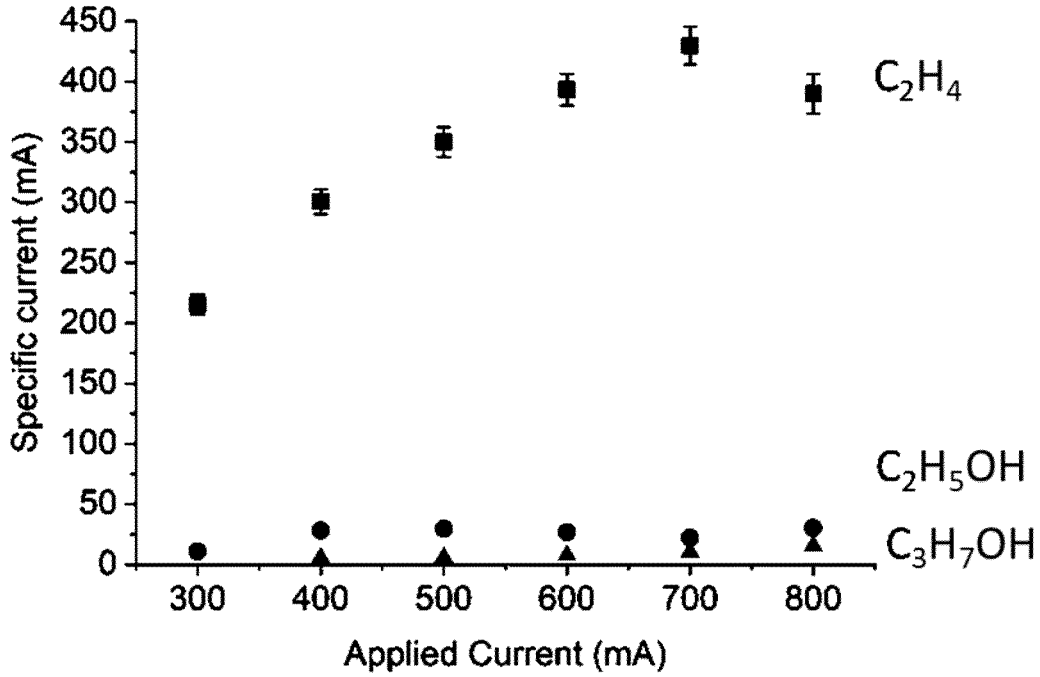
FIG. 7 shows the partial current for ethylene, ethanol and n-propanol production at different constant applied currents during the CO electroreduction.

In the case of CO electroreduction, a flow of pure CO (for example at a flow rate of 40 ml/min) was provided to the cathode and the conditions (anode material and electrolyte) were the same as for $CO_2$ reduction. Electrolysis was carried out at constant currents from 300 to 800 mA. Product FE and specific currents are given in FIG. 6. The major CO reduction product was ethylene, together with minor amounts of alcohols (ethanol and n-propanol) with a total FE value below 10% and competing for producing hydrogen. Hydrogen is the only other gaseous product, with FE increasing with increased applied currents. The highest FE for ethylene was 68% for an applied current of 400 mA (i.e., at a current density of 100 mA/$cm^2$), with a cell potential value of 3.6 V. The partial current for ethylene production increased as a function of applied current up to 700 mA and then declined, due to increased formation of hydrogen (FIG. 7). The highest FE for $C_{2-3}$ products obtained at 400 mA was almost 80%. Among these $C_{2-3}$ products, 88% of the energy was used for ethylene production. In all experiments, the total FE lied between 92 and 100%.

Figure 8:
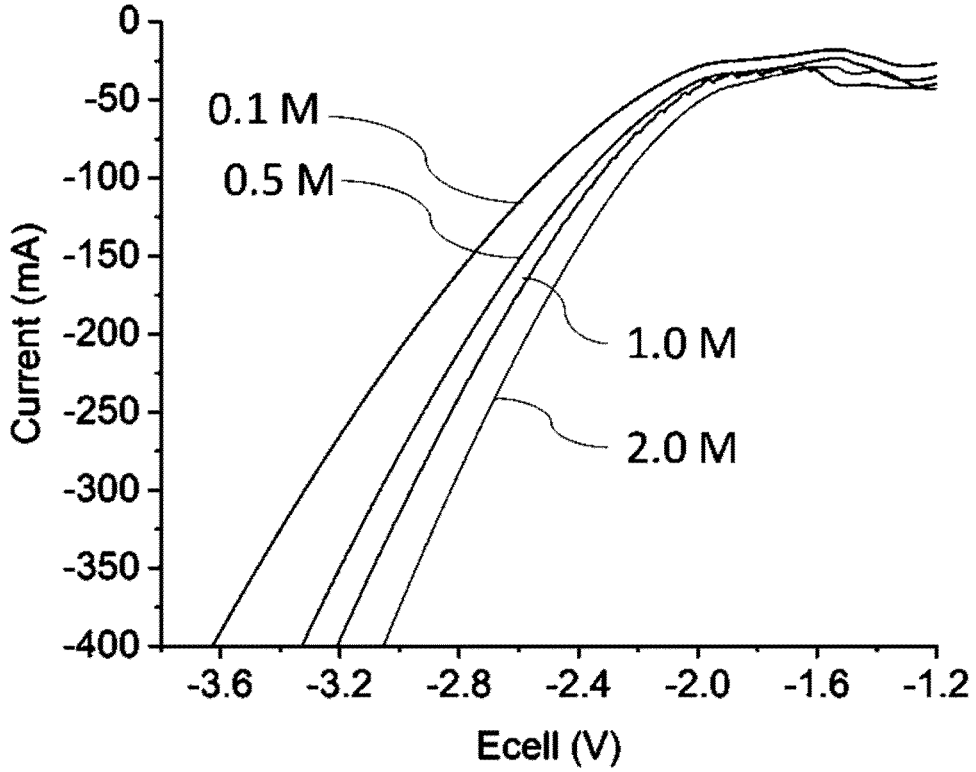
FIG. 8 is a linear sweep voltammogram (LSV) for the CO electroreduction using different anolyte (KOH) concentrations.

As shown from the linear sweep voltammogram (LSV), the system functions with lower cell potentials upon increasing the anolyte KOH concentrations (FIG. 8). For example, for reaching a current of 400 mA, the cell potential is reduced by 400 mV and 600 mV upon increasing KOH concentration from 0.1 M to 1M and 2M, respectively. The cell voltage decreased to 3.2 V when using 2.0 M KOH as the anolyte. Interestingly, the FE of 68% for ethylene production was independent of KOH concentration at an applied current of 400 mA.

Figure 9:
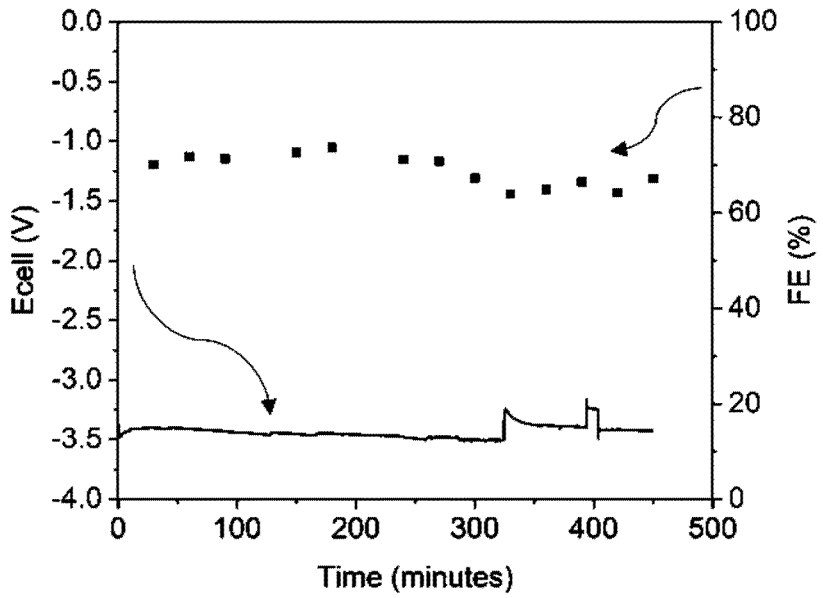
FIG. 9 illustrates the cell potential ($E_{cell}$) during long-term electrolysis at 400 mA for CO electroreduction using 1.0 M KOH as the anolyte. The evolution of the Faradaic Evolution is also illustrated.

Finally, the stability of the system for CO electroreduction was examined at a constant applied current of 400 mA with 1.0 M KOH anolyte for 7.5 hours. FIG. 9 shows that the cell voltage was stable at around 3.3 V with a FE for ethylene production at 68±3% over electrolysis. No deposit of bicarbonate/carbonate salt on the electrode could be observed.

$CO_2$ Electroreduction

Figure 10:
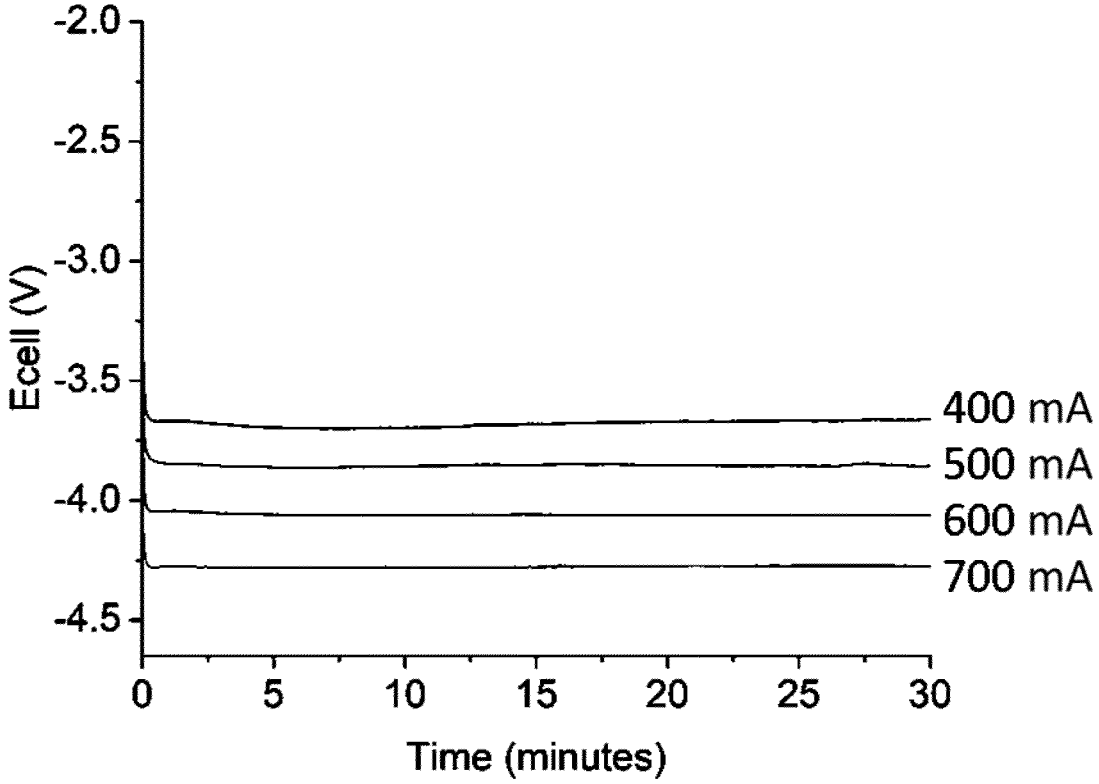
FIG. 10 illustrates the evolution of the voltage during $CO_2$ electrolysis carried out with the electrolyser of the present disclosure.

To evaluate the selectivity of the system for $CO_2$ reduction, constant current electrolysis (CCE) was carried out at different applied currents from 400 mA to 800 mA, for 30 minutes. FIG. 10 shows stable voltages in all cases during electrolysis, with values ranging from 3.6 to 4.3 V, increasing upon increasing applied currents.

Figure 11:
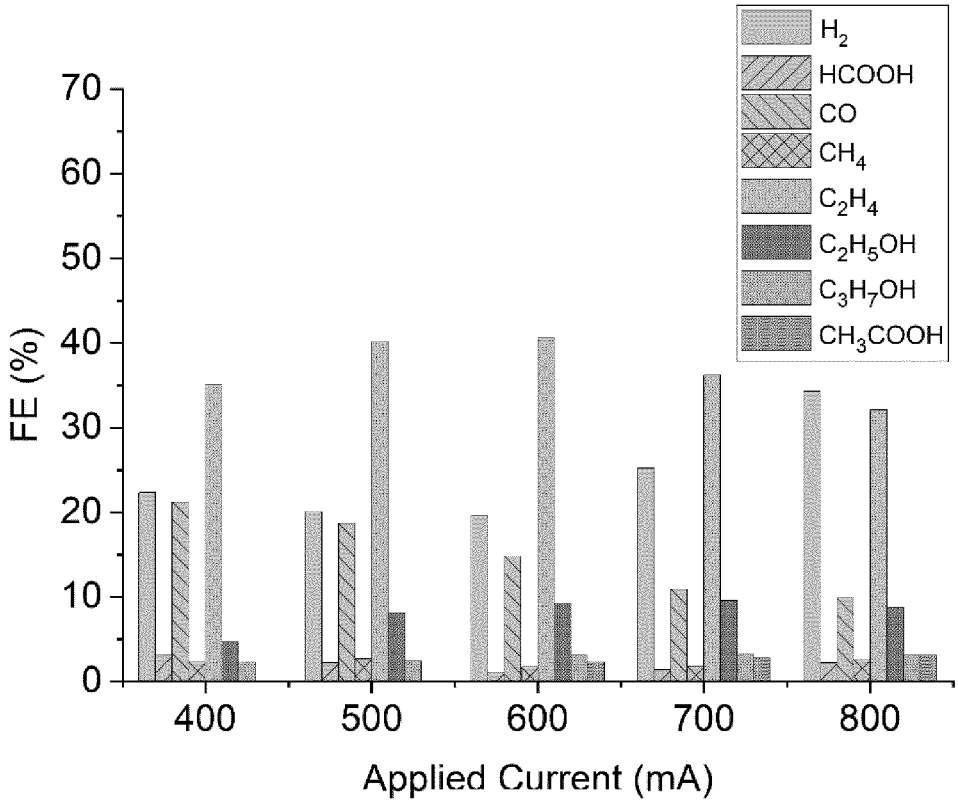
FIG. 11 $CO_2$ reduction by using a one-gap electrolyzer.
Figure 12:
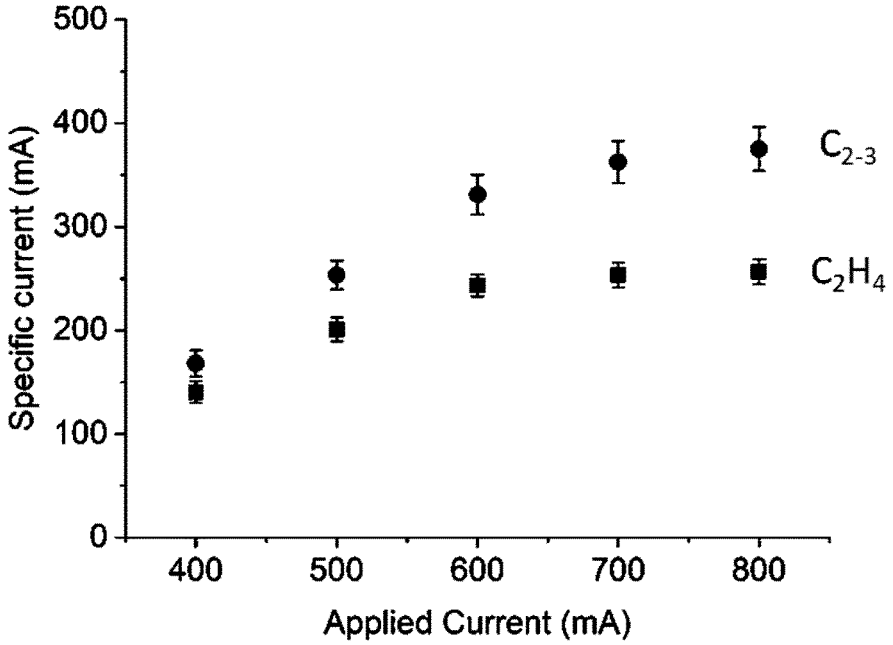
FIG. 12 shows the partial current for ethylene and $C_{2-3}$ production at different constant applied currents during the $CO_2$ electroreduction.

As shown in FIG. 11, in all cases, ethylene was the major $CO_2$ reduction product with the highest selectivity (FE=41%) obtained for applied currents between 500 and 600 mA. The gas-phase coming out from the cathode also contained CO, $CH_4$ and $H_2$, with the latter increasing at high currents (700 and 800 mA). The total FE was at around 94%±3%. The Faradaic efficiency for CO production was maximum (21%) at a current of 400 mA and decreased upon increasing the applied current. Methane is accounted for less than 2.0%. The liquid-phase products (formic acid, ethanol, n-propanol and acetic acid) accounted for a total FE below 15%, with ethanol being the major liquid product (FE 10% at 500-700 mA). As shown in FIG. 12, the specific currents for ethylene and $C_{2-3}$ products formation increased linearly with the applied current up to 600 mA and levelled off at higher currents to the benefit of $H_2$ production, hinting at $CO_2$ mass transfer limitations to the active sites.

The stability of the system was evaluated with a 2 hours electrolysis at a cell applied current of 500 mA. The recorded cell potential was stable at about −3.6 V with the FE for ethylene production remaining at about 39%±2 approximately, during 2 h electrolysis.

However, the formation of bicarbonate/carbonate solid salt after 2 h electrolysis on the backside of the GDC as well as on the gasket. This is the product of the reaction of $CO_2$ with hydroxide ions and potassium ions originating from the anolyte as well as hydroxide ions produced at the cathode during $CO_2$ electroreduction. It can be highlighted that the precipitated material could be easily removed from the GDC by washing with water, and the system then operated for a next 2 h electrolysis with similar performances.

Electrical Energy Efficiencies

Electrical energy efficiencies (eEE) were calculated for the electrochemical conversion of $CO_2$ to ethylene for the one-step conversion in an MEA low-temperature electrolyser ($2\ CO_2 \rightarrow C_2H_4$) and the tandem route in a high-temperature electrolyser ($CO_2 \rightarrow CO$) followed by an MEA low-temperature electrolyser ($2\ CO \rightarrow C_2H_4$). The electrical energy efficiency eEE of the one-step conversion and the tandem conversion were calculated via the following equations:

$$eEE_{2CO2\rightarrow C2H4} = \frac{\Delta G^0_{CO2\rightarrow C2H4,\,25^\circ C.}\left[\frac{kJ}{mol}\right]}{eE_{2CO2\rightarrow C2H4,\,25^\circ C.}\left[\frac{kJ}{mol}\right]} \times FE_{CO2\rightarrow C2H4}$$

$$eEE_{2CO2\rightarrow 2CO\rightarrow C2H4} = \frac{\Delta G^0_{CO2\rightarrow C2H4,\,25^\circ C.}\left[\frac{kJ}{mol}\right]}{eE_{2CO2\rightarrow 2CO,\,750^\circ C.}\left[\frac{kJ}{mol}\right] + eE_{2CO\rightarrow C2H4,\,25^\circ C.}\left[\frac{kJ}{mol}\right]} \times FE_{CO\rightarrow C2H4}$$

The resulting electrical energy efficiencies and the relevant technical values for their calculation, obtained in this and other relevant works are compiled in Table 1.

Considerably higher overall electrical energy efficiencies could be found for the tandem conversion. This is because considerably lower cell voltages of the conversion of $CO_2$ to CO and of CO to ethylene compared to the one-step conversion were observed, while comparable selectivities could be attained for the one-step and tandem conversion. The overall energy efficiency calculated for this work is among the best with 30.5%.

TABLE 1

Electrical energy efficiencies and relevant technical values for their calculation of the one-step and tandem conversion obtained in this and other relevant works are compiled in this table.

| Reaction | Number of electrons | Standard Gibbs free energy | References | Cell voltage | Electrical energy eE | Faraday efficiency FE | Overall electrical energy efficiency eEE |
|---|---|---|---|---|---|---|---|
| | | | One-step conversion | | | | |
| $2\ CO_2 + 2\ H_2O \rightarrow C_2H_4 + 3\ O_2$ | 12 | 1331 KJ | This work | 3.65 V | 4226 kJ | 35% | 11% |
| | | | I | 3.65 V | 4226 kJ | 64% | 20% |
| | | | Tandem conversion | | | | |
| $2\ CO_2 \rightarrow 2\ CO + O_2$ | 4 | 514 KJ | II | 1.3 V | 502 kJ | 100% | Values below include this step |
| $2\ CO + 2\ H_20 \rightarrow C_2H_4 + 2\ O_2$ | 8 | 817 KJ | This work | 3.2 V | 2470 kJ | 68% | 30.5% |
| | | | III | 2.32 V | 1791 kJ | 38% | 22.0% |
| | | | IV | 2.7 V | 2084 kJ | 60% | 30.9% |

I. Sargent et al. *Nature* 2020, 577, 509-513
II. Kungas R (*J. Electrochem. Soc.*, 2020, 167, 044508)
III. Kanan et al., *Joule* 2019, 3, 240-256
IV. Sinton et al. *Joule* 2021, 5, 706-719

The results point to the D-CuO/MEA system as one of the most selective ones for CO electroreduction to ethylene at relevant current densities (>0.1 A/cm$^2$) reported so far.

Table 1 summarizes the previous MEA and flow-cell systems used for pure CO electroreduction, leading to FE for ethylene above 35% and partial current densities above 40 mA·cm$^{-2}$, for comparison. It is here focused on selectivity and thus FEs. Previous FE values for ethylene ranged from 38% and 65%, using different cell configurations, however with great differences in terms of partial current densities. The best performances within the flow cells were obtained by Sargent and Sinton with a high FE for ethylene of 65% and a high partial current density.

The D-CuO/MEA system presented here compares well with the very few previously reported MEA systems. At comparable partial current densities (50-100 mA·cm$^{-2}$), the pioneering system by Kanan and collaborators produced ethylene with FE=38%, using the same 1.0 M KOH anolyte concentration. The second system of interest, reported during this study, is the MEA developed by Sargent/Sinton produced ethylene with FE=60%, however using more alkaline conditions (3M KOH) which increases the selectivity for ethylene; as a matter of fact, the same system yielded ethylene FE of 53% in 1M KOH.

One specific advantage of D-CuO catalyst is that its synthesis is quite trivial while the catalyst by Sargent/Sinton implies electrodeposition of Cu under $CO_2$, an electrodimerization step to introduce a layer of a tertrahydrobipyridine derivative and finally deposition of an ionomer coating.

In Table 1, using an optimal $CO_2$ to CO electrochemical step, as described in Kungas, our data led to a record electrical energy efficiency above 30%, comparable to that obtained by Sargent and Sinton. In the latter case, this number was achieved thanks to a low cell potential while in our case mainly thanks to a larger selectivity.

Thanks to the electrolyser of the present disclosure a Faradaic Efficiency (FE) at 68% for ethylene production was obtained during CO reduction at applied current densities of 100-125 $mA \cdot cm^{-2}$ using a dendritic copper oxide (D-CuO) catalyst integrated into an MEA system. It has been observed that the selectivity for ethylene decreased at higher current densities, due to the increase of $H_2$ formation, which hints at CO mass transfer limitations. Ethylene and $H_2$ are the only gaseous products, while the liquid products, mainly alcohols (ethanol and n-propanol), accounted for a total FE of less than 10%. In comparison, a FE of 41% for ethylene production was obtained via $CO_2$ electroreduction using the same system and the specific current for ethylene production is lower than that obtained from CO electroreduction. Finally, the D-CuO catalyst and the CO reduction system are quite stable as shown from long-term electrolysis. No formation of bicarbonate or carbonate salt occurred during CO reduction operation.

Example 2

Preparation of the D-Cu Catalysts

Figure 14:
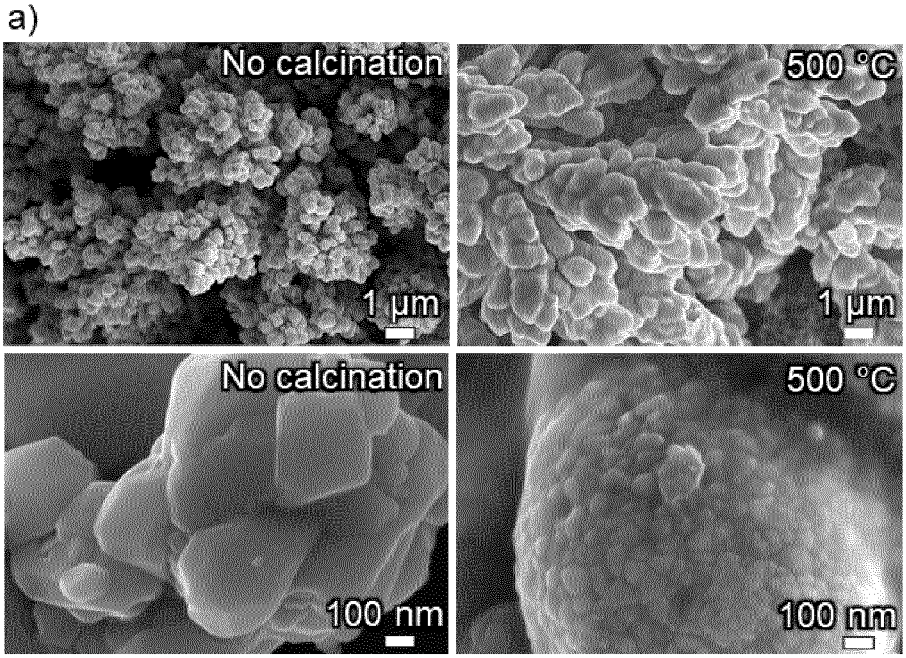
FIG. 14 a) SEM images, b) XRD patterns, c) XPS spectra of D-Cu calcined at different temperatures.
Figure 14:
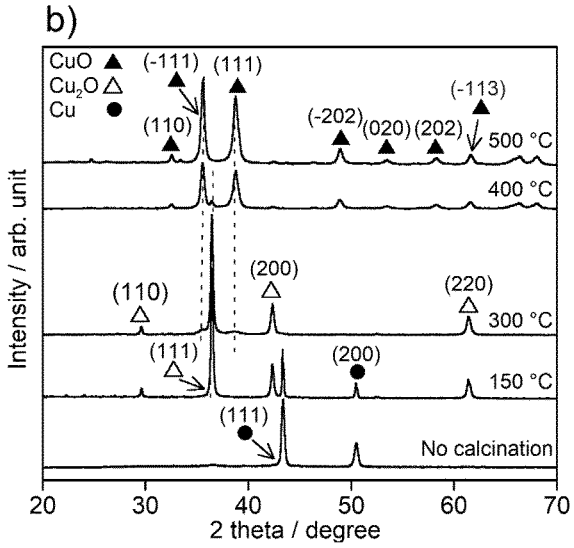
Figure 14:
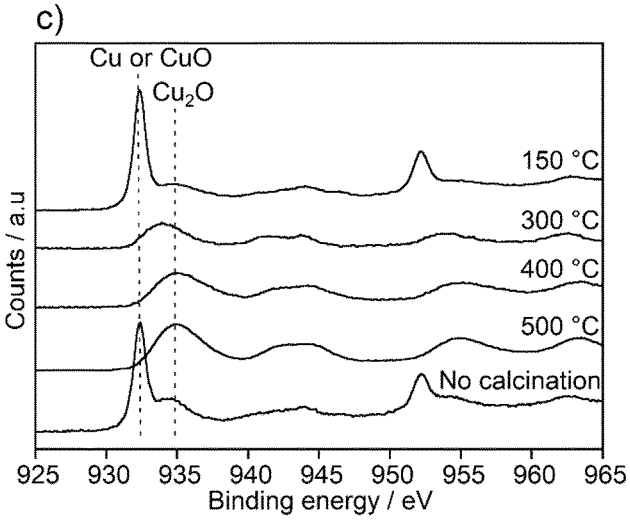

Electrodeposition of Cu on a Cu plate electrode from an acidic $CuSO_4$ solution was carried out. A large current (0.5 $A \cdot cm^{-2}$) was applied during a short period of time (80 s) using a solution of 0.1M $CuSO_4$ containing different $H_2SO_4$ concentrations (from 0.5M to 2.88M). The large acid concentration resulted in an intense formation of hydrogen bubbles at the Cu plate electrode which contributed to Cu deposition in the form of a nanostructured foam, consisting of three-dimensional porous dendritic Cu, as shown by SEM images (FIG. 14*a*). Then the different materials, named D-Cu in the following, were used for electrolysis immediately or after an annealing step during which the solids were calcinated at various temperatures from 150 to 500° C. The samples will thus be named D-$Cu_{xMy}$, xM indicating the concentration of the acid used during electrodeposition and y the annealing temperature. For samples not annealed, y will be omitted and the sample named D-$Cu_{xM}$.

Characterization of the D-Cu Catalysts

Figure 15:
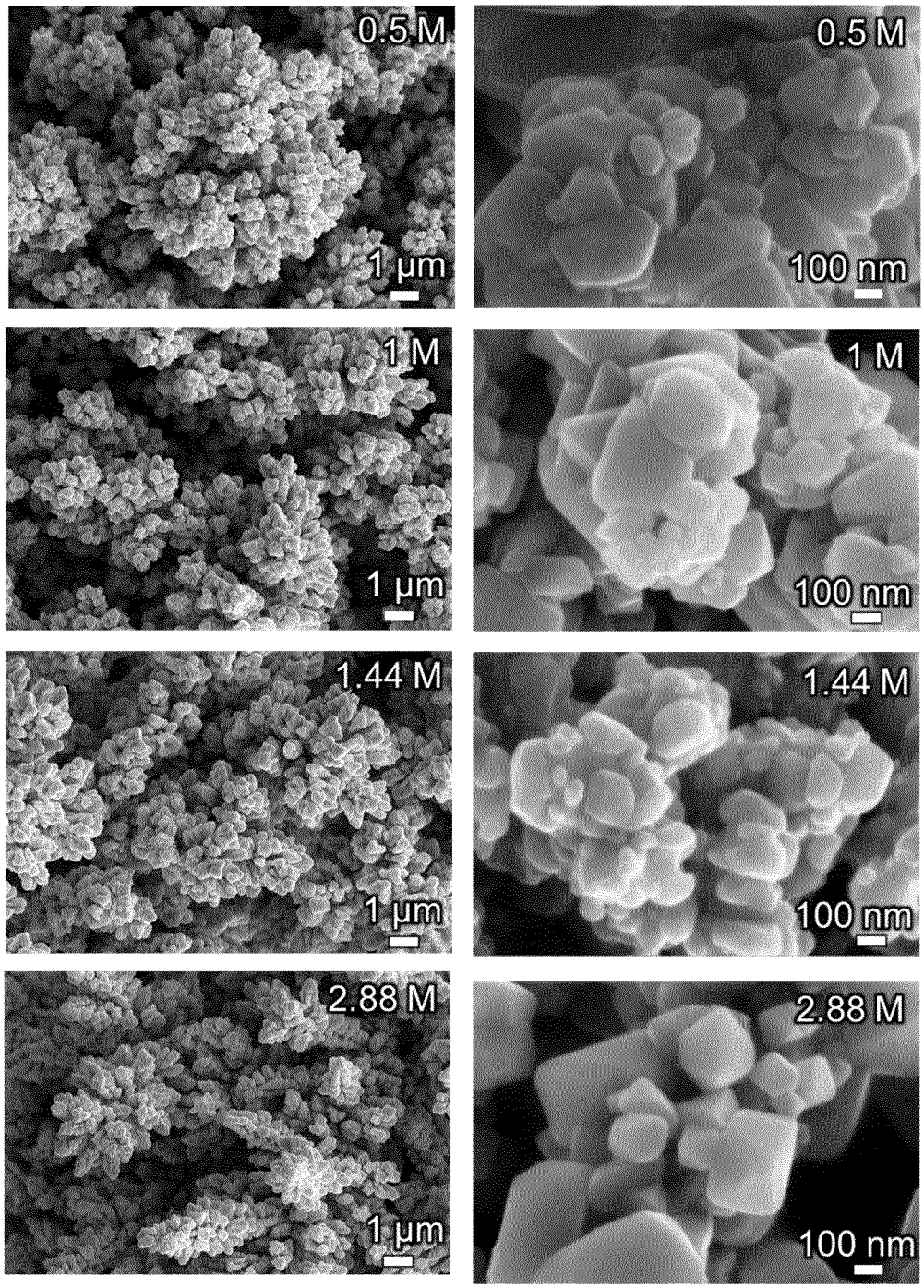
FIG. 15 SEM images of different D-Cu samples electrodeposited under different $H_2SO_4$ concentrations at a constant current density of $-0.5\ A \cdot cm^{-2}$ FIG. 16 ESCA of D-Cu synthesized with different sulfuric acid concentrations compared to Cu reference.
Figure 16:
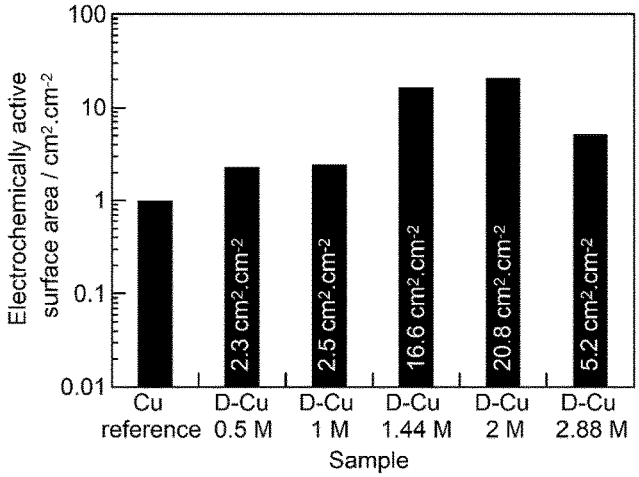

Scanning electron microscopy (SEM) images of the D-$Cu_{xM}$ materials deposited on the electrodes before calcination are shown in FIG. 14*a* and FIG. 15. They revealed a porous structure with the presence of a dendritic network within the deposited layer. The $H_2SO_4$ concentration used during electrodeposition seems to have little effect on the morphology of the surface. In contrast, the electrochemical surface area (ECSA) of the different electrodes, as measured by the double layer capacitance (CDL) method (*Joule* 5, 1281-1300 (2021) and *Nat. Mater.* 18, 1222-1227 (2019).), were significantly different from each other (FIG. 16), with the D-$Cu_{2M}$ sample exhibiting the highest CDL value.

Figure 17:
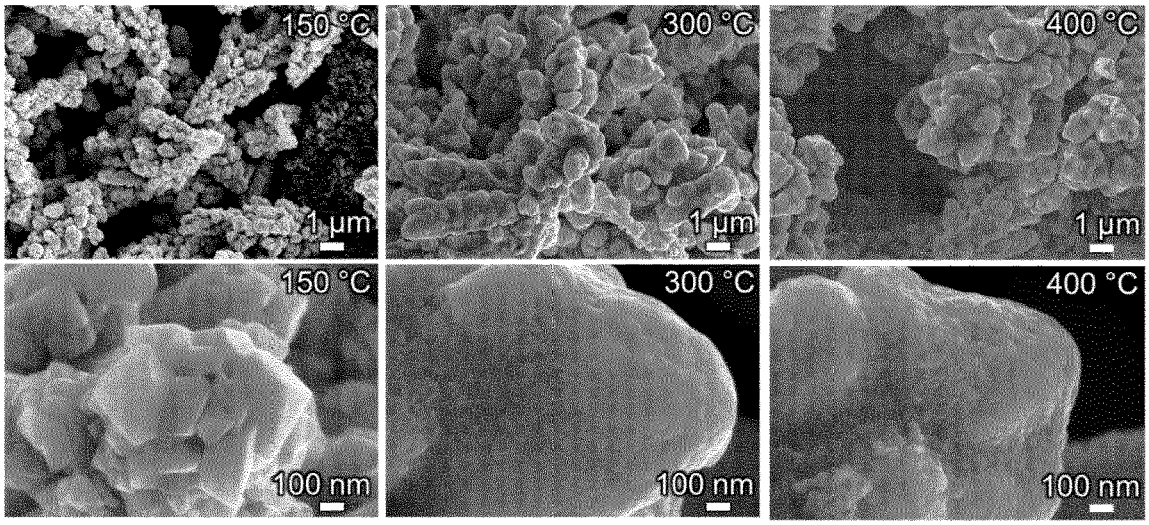
FIG. 17 SEM images of 2M acid D-Cu sample electrodeposited at 2.0M $H_2SO_4$ after calcination at different temperatures

SEM was also used to characterize the D-$Cu_{2M}$ sample after calcination at different temperatures (FIG. 14*a* and FIG. 17). It clearly shows that calcination retained the dendritic overall structure but also modified the surface via the formation of a layer of nanoparticles at a temperature above 300° C. The size of the nanoparticles also varied with the calcination temperature.

To get further insights into the structure of the different materials, X-ray diffraction (XRD) and X-ray photon spectroscopy (XPS) analysis was carried out. FIG. 14*b* shows the powder XRD patterns obtained for the D-$Cu_{2M}$ and D-$Cu_{2My}$ materials (y=150, 300, 400 and 500). A mixture of $Cu_2O$ and CuO was observed for samples treated at temperatures below 300° C., while only CuO was observed at 400° C. and 500° C. This analysis was confirmed by XPS (FIG. 14*c*).

CO Electroreduction Using D-Cu Catalysts in Flow Electrolyser

The cathode was prepared by drop-cast deposition of D-Cu powder onto a hydrophobic Gas Diffusion Layer (GDL) before integration. of the resulting Gas Diffusion Electrode (GDE) in the flow electrolyser.

Preparation of D-Cu Catalyst Loaded onto Gas-Diffusion Electrode (D-Cu/GDE)

D-Cu powder was prepared by an electrochemical deposition method. Aqueous solutions of $CuSO_4$ 0.1 M and $H_2SO_4$ 0.5, 1, 1.44, 2 or 2.88 M were made from $CuSO_4 \cdot 5H_2O$ (Sigma-Aldrich, 99.0%) and $H_2SO_4$ (Sigma-Aldrich, 95-98%). A Cu plate (Alfa Aesar, 0.1 mm thick, 99.999%) was dipped in those solutions, then a current density of −0.5 $A \cdot cm^{-2}$ was applied to the Cu plate for 80 s to obtain a brownish red powder. After rinsing with water and ethanol (96°, Carlo Erba), the powder was dried naturally, then collected by slightly scratching. The thus obtained powder was calcined at 150-500° C. for 1 h in the air using an aluminum foil.

Preparation of gas-diffusion electrode: A suspension of catalyst powder (1 mg), Nafion 5% from Sigma-Aldrich (5 μL) and ethanol (100 μL) was drop-casted onto a gas diffusion layer (GDL-AvCarb GDS5130, Dioxide Materials) heated at 60° C. to obtain a ratio of 1 mg of catalyst/1 $cm^2$ of GDL.

Figure 18:
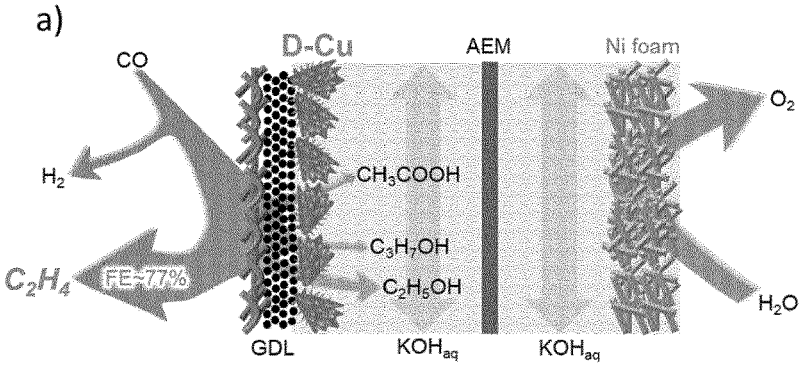
FIG. 18: a) Scheme of the two-gap electrolyzer employed in this study, b) FE for CO reduction of D-Cu synthesized with different sulfuric acid concentrations and c) FE for CO reduction of D-Cu synthesized with 2 M of sulfuric acid and calcined at different temperatures.
Figure 18:
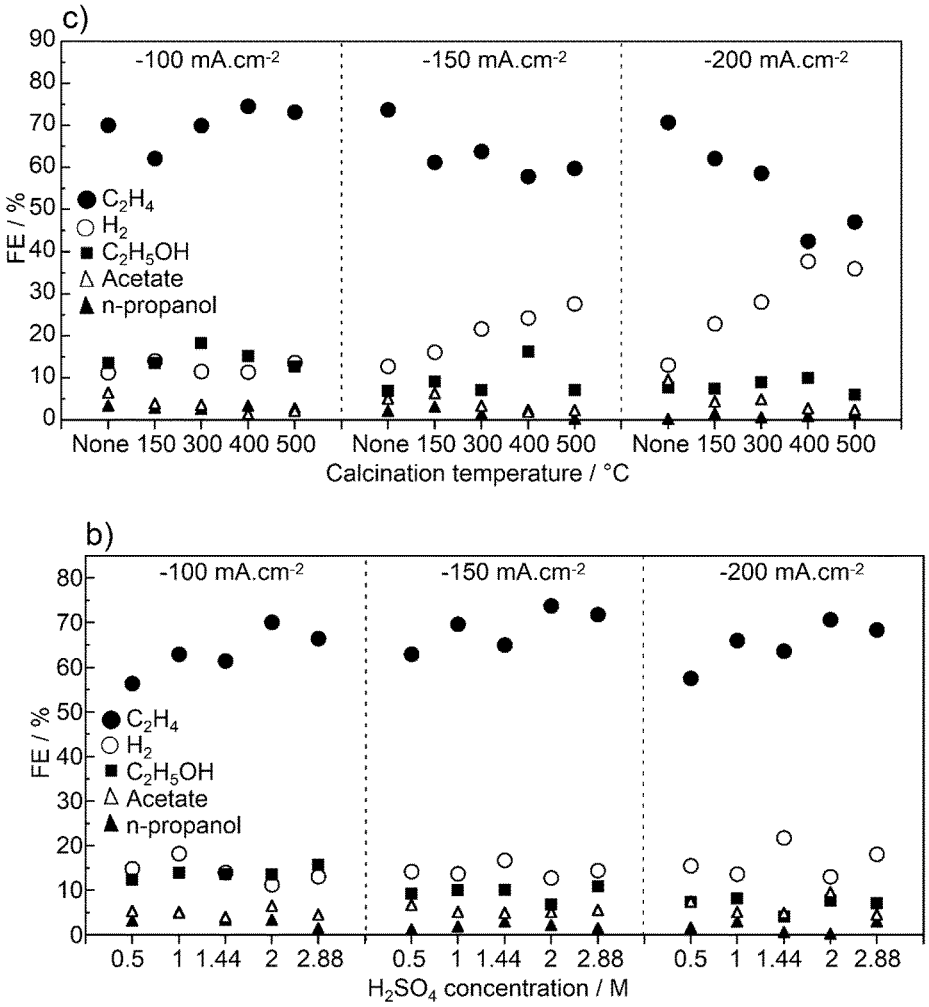

The schematic view of the electrolyser used is shown in FIG. 18*a*, the electrolyser is a two-gaps electrolyser. CO was fed on the backside of the GDE, Ni foam was used as the anode and an anion exchange membrane (AEM) was used to separate the two compartments. A 1.0M KOH electrolyte solution circulated through the two compartments at a controlled flow rate using a peristaltic pump. The cathodic and anodic potentials were measured via two micro reference electrodes and the cell potential was also recorded during electrolysis.

Figure 19:
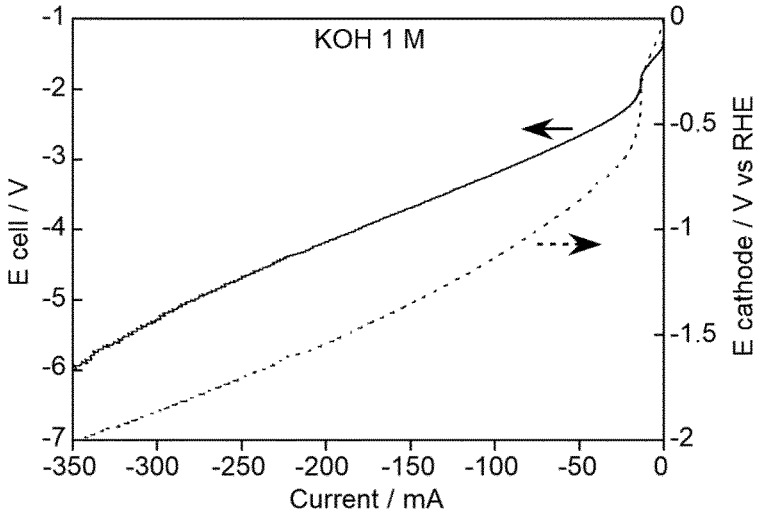
FIG. 19: LSV of CO reduction using 2M acid D-Cu in flow electrolyze using 1.0M KOH electrolyte for both cathode and anode compartment.

A Linear Sweep Voltammogram (LSV) is shown in FIG. 19, demonstrating the actual catalytic CO electroreduction occurring at high current densities for relatively moderate cell potentials (Ecell) and cathode potentials (for example up to 200 mA·cm-2 for Ecell=4V and Ecathode=−1.5V vs RHE).

Figure 20:
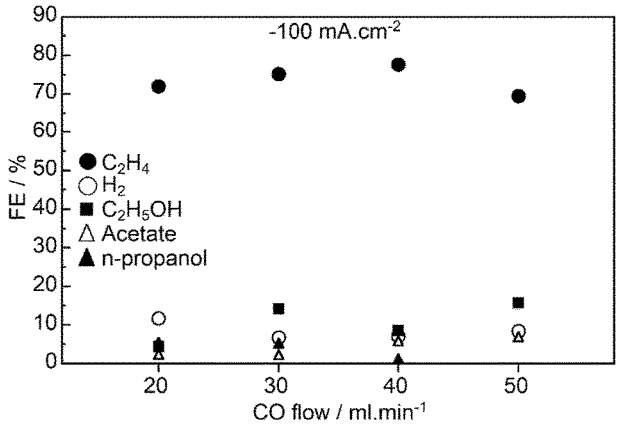
FIG. 20: the effect of CO flow on the selectivity of different products at −100 $mA \cdot cm^{-2}$ CO electrolysis using 2M acid D-Cu in 3.0 M KOH electrolyte.

The results of bulk electrolysis for CO reduction at controlled applied current densities (100, 150 and 200 $mA \cdot cm^{-2}$) for 30 minutes using all the D-Cu samples prepared above are presented in FIGS. 18*b* and 18*c*. The gas-phase contained only ethylene as a CO-derived product, by far the major product, together with $H_2$, accounting for a faradic efficiency (FE) below 20%, at all applied current densities. The liquid phase, analyzed by NMR spectroscopy, was shown to contain minor amounts of ethanol, acetate and n-propanol. Among them, ethanol was obtained with the highest selectivity, with a FE below 15%. FIG. 18*b* shows the results obtained with D-$Cu_{xM}$ samples (before calcination), with x=0.5, 1, 1.44, 2, 2.88. We observed a trend in which the FE for ethylene increased with acid concentration. Based on FIG. 18*b*, D-$Cu_{2M}$ exhibited the highest selectivity for ethylene ($FE_{C2H4}$>70%) at all tested current densities. Using this sample, the effect of CO flow rate on the selectivity of CO electroreduction has been also investigated. FIG. 20 shows the results of that study, using flow rate values ranging from 20 to 50 ml/min using an applied current density of −100 mA·cm$^{-2}$. An impressive $FE_{C2H4}$ value of 78% was obtained for a flow rate of 40 ml/min. Interestingly under these conditions, the FE value for $H_2$ is below 10%, so that D-$Cu_{2M}$ displayed a remarkable selectivity for the formation of C2+ products (total FE>90%), with no formation of C1 products.

FIG. 18*c* shows the results obtained with the D-$Cu_{2My}$ samples with y=150, 300, 400 and 500. While calcination had quite small effects on the selectivity of CO electroreduction at an applied current of −100 mA·cm$^{-2}$, it was very deleterious to the $FE_{C2H4}$ at higher current densities. FIG. 1*c* clearly shows that, at applied current densities above −100 mA·cm-2, $FE_{H2}$ increased and $FE_{C2H4}$ decreased with increasing the annealing temperature. The D-$Cu_{2M}$ sample (no calcination) was the only one displaying the same selectivity at all current densities (FE=70-73%) and was exclusively used in the following.

Figure 23:
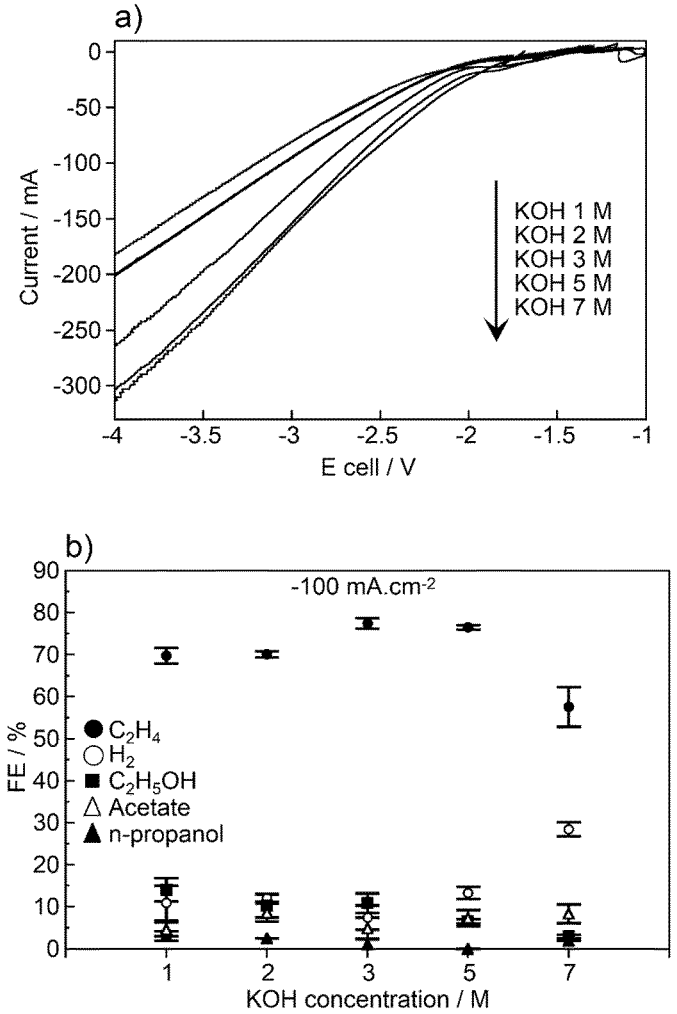
FIG. 23: a) LSV in different KOH concentrations of D-Cu synthesized with 2 M of sulfuric acid, b) Effect of KOH concentrations on CO reduction using D-Cu synthesized with 2 M of sulfuric acid.

Finally, the effect of KOH concentration on the selectivity of the reaction was studied. As shown from the LSVs shown in FIG. 23, increasing KOH concentration from 1.0 to 7.0 M led to a more efficient system, producing higher current densities for any given applied cell potential (at 7.0 M KOH the current density could reach a value of 320 mA·cm$^{-2}$ at a cell potential of 4.0 V), as a likely consequence of the increased conductivity of the electrolyte, lowering the resistance of the system. CO electroreduction was thus carried out at a constant current density of −100.0 mA·cm$^{-2}$ for 30 minutes using different KOH concentrations. Products analysis led to the results shown in FIG. 23*b*. The highest selectivity for ethylene ($FE_{C2H4}$=78%) was observed for a KOH concentration of 3.0 M. At other KOH concentrations, the selectivity was significantly lower with $FE_{C2H4}$ varying from 65 to 75% FE.

Figure 21:
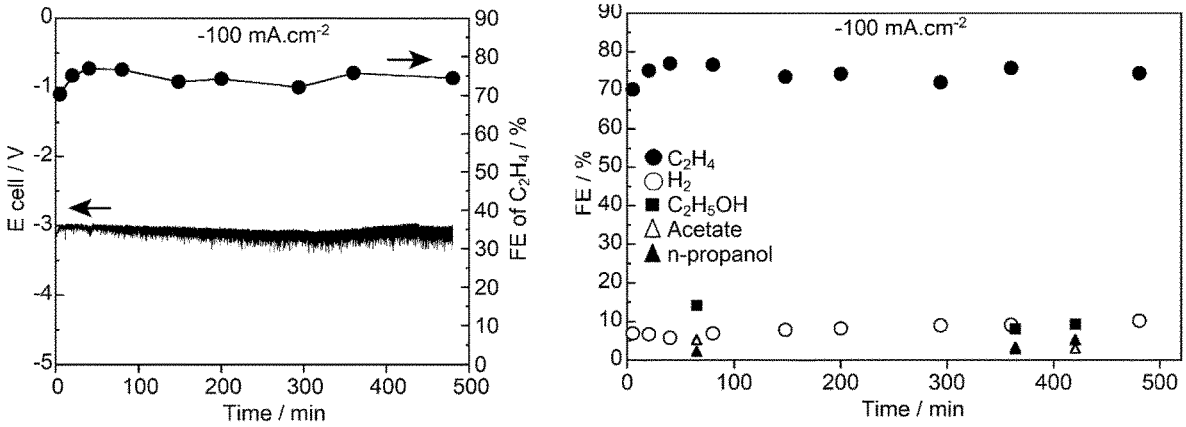
FIG. 21: Long-term CO reduction of D-Cu synthesized with 2 M of sulfuric acid. Electrolyte: KOH 3 M.
Figure 22:
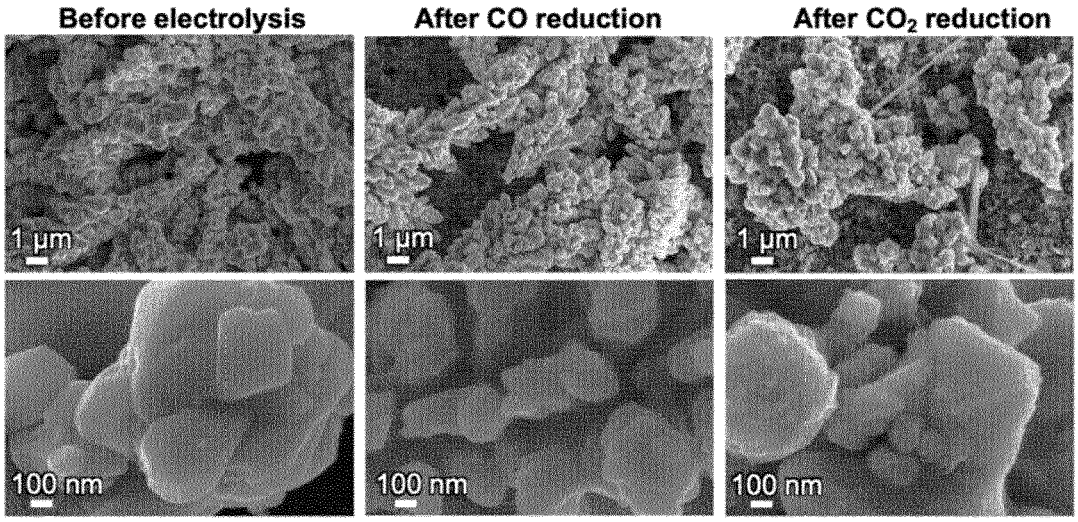
FIG. 22: SEM images of 2M acid D-Cu and D-Cu500 samples after CO and CO2 reduction at −100 mA·cm-2 in 1 h

Finally, a long-term (8 hours) electrolysis at −100 mA·cm$^{-2}$ using D-$Cu_{2M}$ in 3.0 M KOH has been carried out (FIG. 21). The system proved stable during the 8 hours, with the cell potential staying at 3.0 V, the $FE_{C2H4}$ staying at 75+/−3% and without any significant variations of the FE for the other products including $H_2$ ($FE_{H2}$<1° %). The catalyst was characterized by SEM after electrolysis (FIG. 22).

$CO_2$ Reduction

Figure 24:
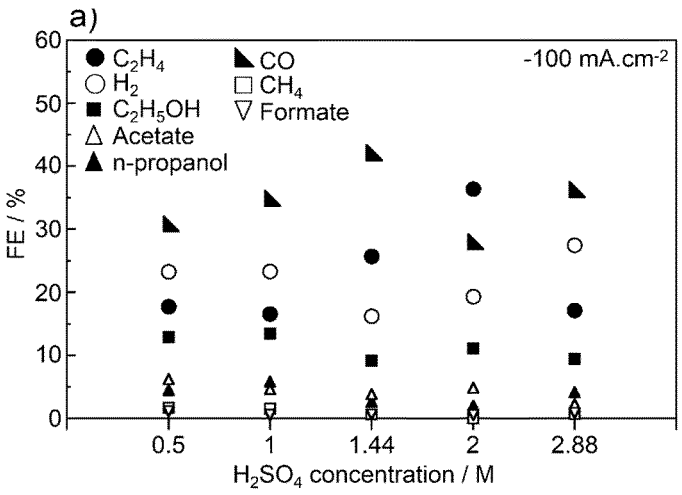
FIG. 24: a) FE for CO2 reduction of D-Cu synthesized with different sulfuric acid concentrations, electrolyte: KOH 1 M, b) Effect of calcination on FE for CO2 reduction of D-Cu synthesized with 2 M of sulfuric acid, electrolyte: KOH 1 M.
Figure 24:
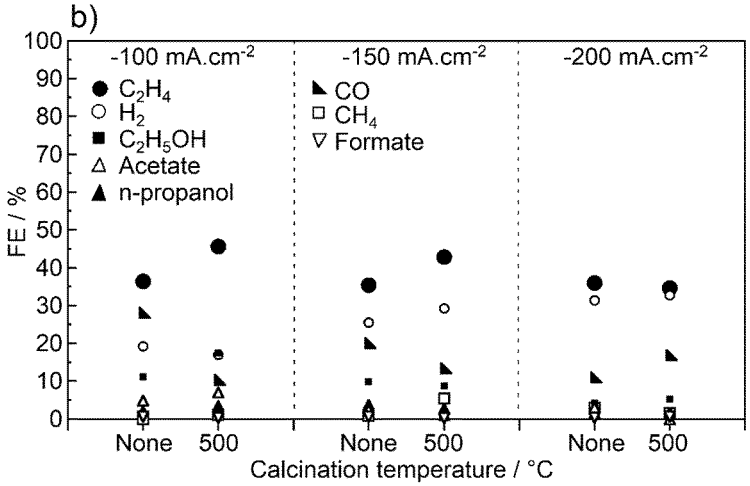

Electrochemical reduction of $CO_2$ has been carried out using the same flow electrolyser setup with a flow of $CO_2$ gas replacing CO. The same series of D-$Cu_{xM}$ samples (electrodeposited using different acid concentrations and without annealing) were tested for $CO_2$ reduction in 1.0 M KOH at a constant current density of 100 mA·cm$^{-2}$. As shown in FIG. 24*a*, with $CO_2$ as the substrate, CO and $C_2H_4$ were the major gaseous products and $H_2$ accounted for $FE_{H2}$ of 15-30%. Ethanol was the major liquid product with FE values in the 10-15% range. Furthermore, FIG. 24*a* shows that the acid concentration used during electrodeposition had a significant effect on the selectivity of the reaction since the major product was CO at low concentrations ($FE_{CO}$ up to 45% for 1.44 M) while $FE_{C2H4}$ increased with acid concentration to reach a maximal value of 37% at 2M. Increasing the acid concentration further resulted in D-$Cu_{2.88M}$, much more active for $H^+$ reduction ($FY_{H2}$=30%). Following these studies, the D-$Cu_{2M}$ sample was used to evaluate the effect of adding a calcination step (temperatures: 150, 300, 400 and 500° C.) on the selectivity of the reaction. In all cases, a calcination step was beneficial to ethylene formation and the higher the calcination temperature the higher the $FE_{C2H4}$. FIG. 24*b* compares D-$Cu_{2M}$ and D-$Cu_{2M500}$ at different current densities. The highest $FE_{C2H4}$ value of 45%, together with a $FE_{C2H5OH}$ value of 17%, was achieved with D-$Cu_{2M500}$ using a current density of −100 mA·cm$^{-2}$. Increasing the current density to −200 mA·cm$^{-2}$ led to a decrease in $FE_{C2H4}$ and $FE_{C2H5OH}$ together with an increase in $FY_{H2}$.

The invention claimed is:

1. Process for electrolysing one or more carbon oxides into one or more hydrocarbons characterized in that it comprises the following steps:

b) preparing a cathode catalyst by electrodeposition of Cu on a Cu electrode from an acidic $CuSO_4$ solution;

c) providing an electrolyser comprising a gas diffusion cathode, an anode and an ion-exchange membrane in between said gas diffusion cathode and said anode, wherein the electrolyser is selected from a zero-gap electrolyser, a two-gaps electrolyser, a catholyte-free one-gap electrolyser and a catholyte-containing one-gap electrolyser, and wherein the ion-exchange membrane is an anion-exchange membrane or a bipolar membrane;

d) providing an input flow at the gas diffusion cathode, the input flow comprising one or more carbon oxides selected from carbon monoxide or a mixture of carbon monoxide and carbon dioxide;

e) providing an anolyte solution at the anode and optionally a catholyte solution at the gas diffusion cathode;

f) applying an electric current between the gas diffusion cathode and the anode; and g) recovering, at the gas diffusion cathode, an output flow comprising one or more hydrocarbons comprising ethylene;

and in that step (b) of preparing a cathode catalyst by electrodeposition of Cu comprises a calcination substep performed at a temperature of at least 300° C. to obtain a dendritic copper oxide catalyst and the electrolyser provided at step (c) further comprises a first interface in between the gas diffusion cathode and the ion-exchange membrane, wherein the first interface comprises a cathode catalyst being a dendritic copper oxide catalyst.

2. The process according to claim 1, characterized in that the anode comprises an anode catalyst that is or comprises one or more selected from $IrO_2$, nickel foam and nickel-iron oxide.

3. The process according to claim 1, characterized in that the acidic $CuSO_4$ solution contains $CuSO_4$ at a concentration ranging from 0.05 to 0.5 M and $H_2SO_4$ at a concentration ranging from 0.5 to 3.0 M.

4. The process according to claim 1, characterized in that step (b) of preparing a cathode catalyst by electrodeposition of Cu is performed at a current ranging from 0.05 A·cm$^{-2}$ to 5.0 A·cm$^{-2}$ for a time ranging from 20 to 500 seconds.

5. The process according to claim 1 characterized in that the cathode catalyst is a dendritic copper oxide catalyst and comprises CuO (111) as determined by XRD.

6. The process according to claim 1, characterized in that the cathode catalyst is a porous dendritic material and shows pores with a pore size ranging from 100 nm and 500 μm.

7. The process according to claim 1, characterized in that the cathode catalyst is selected to have an electroactive surface area ranging from 15 cm$^2$ cm$^{-2}$ to 25 cm$^2$ cm$^{-2}$.

8. The process according to claim 1, characterized in that the electric current applied between the gas diffusion cathode and the anode at step (f) has a current density ranging from 25 mA/cm$^2$ to 300 mA/cm$^2$.

9. The process according to claim 1, characterized in that the anolyte solution provided at step (e) is an aqueous solution of one or more alkaline compounds wherein the one or more alkaline compounds are selected from KOH, NaOH, $Ca(OH)_2$, LiOH, $Mg(OH)_2$, RbOH, CsOH and any mixture thereof.

10. The process according to claim 1, characterized in that the anolyte solution provided at step (e) is an aqueous solution of one or more alkaline compounds and the concentration of the one or more alkaline compounds in said aqueous solution is ranging from 0.1 M to 7.0 M; with preference from 1.0 to 5.0 M.

11. The process according to claim 1, characterized in that the catholyte solution provided at step (e) is an aqueous solution of one or more alkaline compounds wherein the one or more alkaline compounds are selected from KOH, NaOH, $Ca(OH)_2$, LiOH, $Mg(OH)_2$, RbOH, CsOH and any mixture thereof.

12. The process according to claim 1, characterized in that the catholyte solution provided at step (e) is an aqueous solution of one or more alkaline compounds the concentration of the one or more alkaline compounds in said aqueous solution is ranging from 0.1 M to 7.0 M; with preference from 1.0 to 5.0 M.

13. The process according to claim 1, characterized in that the process is a tandem carbon dioxide electroreduction process and comprises a step (a) of providing a feedstream comprising carbon dioxide and performing a preliminary conversion of at least a part of the carbon dioxide of said feedstream into carbon monoxide to obtain an input flow comprising at least 1 mol. % of carbon monoxide based on the total molar content of the carbon oxides present in the input flow wherein said input flow is the one provided in step (d).

14. The process according to claim 13, characterized in that the conversion of carbon dioxide into carbon monoxide is performed through an electoreduction reaction or a water-gas shift reaction.

15. The process according to claim 13, characterized in that the conversion of carbon dioxide into carbon monoxide is performed through an electoreduction reaction or a water-gas shift reaction, to obtain an input flow comprising at least 60 mol. % of carbon monoxide based on the total molar content of the carbon oxides present in the input flow.

16. The process according to claim 1, characterized in that the electric current that is applied at step (f) has an electric potential which is ranging from 2.5 V to 4.5 V.

17. The process according to claim 1, characterized in that the input flow provided in step (d) comprises one or more carbon oxides selected from carbon monoxide or a mixture of carbon monoxide and carbon dioxide, wherein the input flow comprises carbon monoxide at a content of at least 1 mol. % of carbon monoxide based on the total molar content of the carbon oxides present in the input flow.

18. The process according to claim 1, characterized in that the input flow comprises carbon monoxide at a content of at least 60 mol. % of carbon monoxide based on the total molar content of the carbon oxides present in the input flow.

19. The process according to claim 1, characterized in that the input flow provided in step (d) comprises carbon monoxide at a content of at least 80 mol. % of carbon monoxide based on the total molar content of the carbon oxides present in the input flow.

20. The process according to claim 1, characterized in that the electrolyser is a zero-gap electrolyser or a two-gaps electrolyser.

* * * * *